US010059130B2

(12) United States Patent
Aoki

(10) Patent No.: US 10,059,130 B2
(45) Date of Patent: Aug. 28, 2018

(54) RECORDING APPARATUS

(71) Applicant: SEIKO EPSON CORPORATION, Tokyo (JP)

(72) Inventor: Yoshisada Aoki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/902,154

(22) Filed: Feb. 22, 2018

(65) Prior Publication Data

US 2018/0178562 A1 Jun. 28, 2018

Related U.S. Application Data

(62) Division of application No. 14/832,561, filed on Aug. 21, 2015.

(30) Foreign Application Priority Data

Aug. 22, 2014 (JP) ..... 2014-169565
Aug. 22, 2014 (JP) ..... 2014-169575
Aug. 22, 2014 (JP) ..... 2014-169604

(51) Int. Cl.
*B41J 29/38* (2006.01)
*B41J 13/10* (2006.01)
*B41J 11/00* (2006.01)

(52) U.S. Cl.
CPC ..... *B41J 13/103* (2013.01); *B41J 11/0095* (2013.01)

(58) Field of Classification Search
None
See application file for complete search history.

(56) References Cited

U.S. PATENT DOCUMENTS 4,579,471 A 4/1986 Hendrischk
7,058,353 B2 6/2006 Lee
7,621,525 B2 11/2009 Kanome
7,938,394 B2 5/2011 Chino
2003/0098984 A1 5/2003 Botten
(Continued)

FOREIGN PATENT DOCUMENTS

JP 57-192967 11/1985
JP 60-165341 11/1985
(Continued)

OTHER PUBLICATIONS

Office Action issued in U.S. Appl. No. 14/832,561 dated Dec. 28, 2017.

(Continued)

*Primary Examiner* — Matthew Luu
*Assistant Examiner* — Tracey McMillion
(74) *Attorney, Agent, or Firm* — Workman Nydegger

(57) ABSTRACT

There is provided a recording apparatus including: a recording head which executes recording on a recording medium; a first tray which stores a recording medium; a feed roller which is capable of feeding the recording medium in the first tray toward the recording head; a first reflecting portion which is provided on a mounting surface of the recording medium of the first tray; an optical sensor which is provided above the mounting surface of the first reflecting portion in a direction which orthogonally intersects the mounting surface; and a tray detection reflecting portion which is provided below the first tray in a region which overlaps the first reflecting portion in a direction which orthogonally intersects the mounting surface.

3 Claims, 20 Drawing Sheets

(56) References Cited

U.S. PATENT DOCUMENTS

| | | | |
|---|---|---|---|
| 2011/0157271 | A1 | 6/2011 | Terada |
| 2012/0162301 | A1 | 6/2012 | Honoki |
| 2016/0052303 | A1 | 2/2016 | Aoki |

FOREIGN PATENT DOCUMENTS

| | | | |
|---|---|---|---|
| JP | 63-127937 | A | 5/1988 |
| JP | 2006-062842 | | 3/2006 |
| JP | 2009-220976 | A | 10/2009 |
| JP | 2012-176575 | A | 9/2012 |
| JP | 2014015293 | | 1/2014 |

OTHER PUBLICATIONS

Office Action issued in U.S. Appl. No. 14/832,561 dated Sep. 8, 2017.
Office Action issued in U.S. Appl. No. 14/832,561 dated May 17, 2017.
Office Action issued in U.S. Appl. No. 14/832,561 dated Oct. 19, 2016.

RECORDING APPARATUS

This application is a divisional of U.S. application Ser. No. 14/832,561, filed Aug. 21, 2015, which claims priority to Japanese Patent Application No. 2014-169565, filed Aug. 22, 2014, Japanese Patent Application No. 2014-169575, filed Aug. 22, 2014, and Japanese Patent Application No. 2014-169604, filed Aug. 22, 2014, the entireties of which are incorporated by reference herein.

BACKGROUND

1. Technical Field

The present invention relates to a recording apparatus which is provided with a tray which stores a recording medium, a feed roller which is capable of feeding the recording medium which is stored in the tray toward a recording head, and an optical sensor which performs determination of whether or not the recording medium is present in the tray.

2. Related Art

As described in JP-A-2012-176575, in order to support printing of a large number of sheets of paper which exceeds the number of sheets which can be stacked in one feed cassette or printing of different sized sheets of paper, a recording apparatus which is provided with a plurality of feed cassette levels is used in the related art.

In the aforementioned recording apparatus, an independent feed roller is provided for each of the feed cassettes, and the feeding is performed independently. In order to discern whether the paper in the plurality of feed cassette levels is absent or not, a sensor is provided in each of the feed cassettes, and the sensors are used to perform the detection. The feed cassette is provided with a pair of edge guides which restrict the width of the paper.

As described in JP-A-2009-220976, in order to reduce the size of the apparatus and to reduce the number of parts, there is proposed a recording apparatus of a structure in which the paper is supplied independently from a top-level tray and a bottom-level tray using a shared pickup roller, and the recording apparatus of the aforementioned structure is in wide use.

In the aforementioned recording apparatus, a configuration is adopted in which, when feeding the paper which is stored in the top-level tray, the top-level tray is moved in a feed direction so as to overlap a feed position of the bottom-level tray, whereas when feeding the paper which is stored in the bottom-level tray, the top-level tray is moved in a retraction direction from the feed position to cause the top-level tray to retract.

However, since the size of the apparatus is increased and the number of parts increases when a feed roller is provided independently for each of the plurality of prepared feed cassette levels as described in JP-A-2012-176575, the recording apparatus of the aforementioned structure may not be adopted in a usage environment in which there is demand for a reduction in the size and the number of parts of the apparatus.

Since a sensor is provided in each of the feed cassettes to discern whether the paper is present or absent, there is a problem in that the number of parts is many, and the apparatus becomes large. There is no description of performing the sensing of the insertion and removal of the feed cassette to and from the recording apparatus main body using a common sensor.

Since the feed cassette is provided with the edge guides, the moveable regions of the edge guides impose restrictions in the layout of the components which are used in the sensing of the state within the feed cassette, and the tendency is increased for the feed cassette to become larger.

In the recording apparatus of the structure described in JP-A-2009-220976, since the top-level tray moves in relation to the bottom-level tray as described earlier, it is not easy to perform the detection of whether or not there is an absence of the paper which is stored in each of the trays, and it is difficult to install a detection sensor or the like which discerns whether the paper is present or absent.

SUMMARY

An advantage of some aspects of the invention is to enable the determination of whether the recording medium is present or absent in each of the trays using a shared optical sensor by using a recording apparatus which is provided with a multi-level tray which is capable of feeding a recording medium using a shared feed roller.

Another advantage of some aspects of the invention is to enable the determination of whether the recording medium is present or absent in the tray using optical sensing by using a moveable region of the moveable edge guide by using a recording apparatus which is provided with a tray which includes a moveable edge guide which restricts the width of a recording medium which is stored in the tray.

Still another object of some aspects of the invention is to enable the determination of whether the recording medium is present or absent in the tray, and the determination of the insertion state of the tray into the recording apparatus using a shared optical sensor by using a recording apparatus which is provided with a tray which stores a recording medium.

According to an aspect of the invention, there is provided a recording apparatus including: a recording head which executes recording on a recording medium; a first tray which stores a recording medium; a second tray which is positioned above the first tray, is capable of moving between a feeding position and a retraction position, and stores a recording medium; a feed roller which is capable of feeding the recording medium in the first tray and the recording medium in the second tray toward the recording head; a first reflecting portion which is provided on a mounting surface of the recording medium of the first tray; a second reflecting portion which is provided on a mounting surface of the recording medium of the second tray and overlaps the first reflecting portion in a direction which orthogonally intersects the mounting surface in a state in which the second tray is positioned in the feeding position; and an optical sensor which is provided above the mounting surface of the first reflecting portion in a direction which orthogonally intersects the mounting surface.

In this case, it is possible to ascertain whether the recording medium which is stored in the first tray or the second tray is present or absent from the reflected light of the light which is radiated from the optical sensor.

Therefore, when the optical sensor receives the reflected light from the first reflecting portion in a state in which the second tray is in the retraction position, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

Since a structure is adopted in which the shared feed roller is used to perform the feeding of the recording medium which is stored in the first tray and the feeding of the recording medium which is stored in the second tray, it is possible to obtain a reduction in the size and the number of parts of the apparatus.

In addition, when the second tray moves from the retraction position to the feeding position, the first tray assumes a state of being shielded from the light which is radiated from the optical sensor by the second tray. In this state, when the optical sensor receives the reflected light from the second reflecting portion, it becomes possible to determine that the recording medium is absent from the second tray.

Meanwhile, since the second reflecting portion is covered by the recording medium in the state in which the recording medium is present in the second tray, the optical sensor receives the reflected light from the recording medium, but not from the second reflecting portion. Accordingly, it is possible to determine that the recording medium is present in the second tray.

In other words, in the recording apparatus which is provided with the multi-level trays which are capable of feeding the recording medium using the shared feed roller, it is possible to easily perform the determination of whether the recording medium is present or absent in each of the trays using the shared optical sensor. Therefore, even when a user forgets to set the recording medium or the like, the fact thereof is detected, and it is possible to preemptively prevent problems in the operation of the recording apparatus which would otherwise occur.

In the recording apparatus, the first tray may be provided with at least one edge guide which restricts a width of the recording medium and is capable of moving in a width direction, and the first reflecting portion may be disposed in a position which does not interfere with the edge guide.

In this case, it becomes possible to determine whether the recording medium is present or absent in two types of the first tray, the first tray which is provided with the center-meeting type edge guide which is provided with two moveable edge guides, and the first tray which is provided with a one side base-meeting type edge guide which is provided with only one moveable edge guide.

In other words, since the first reflecting portion is provided in a position outside of the movement region of the edge guide which is capable of moving, it is possible to use the edge guide by moving the edge guide to a position corresponding to the width of the recording medium which is set in the first tray, even if various widths of the recording medium are set in the first tray, and it is possible to easily perform the determination of whether the recording medium is present or absent in the first tray.

In the recording apparatus, the edge guide may be formed of a pair of edge guides, and the first reflecting portion may be disposed in a position between the edge guides which does not interfere with the edge guides.

In this case, it is possible to obtain the same operations and effects as in the second aspect in relation to the recording apparatus which is provided with the first tray in which a pair of edge guides are moveable edge guides which are capable of moving together.

In the recording apparatus, the first tray may include a moveable edge guide which restricts a width of the recording medium and is capable of moving in a width direction, and a fixed edge guide which is paired with the moveable edge guide and is not capable of moving, and the first reflecting portion may be provided in a position on the mounting surface outside of a movement region of the moveable edge guide, close to the fixed edge guide.

In this case, it is possible to obtain the same operations and effects as in the first aspect in relation to the recording apparatus which is provided with the first tray in which one edge guide is a moveable edge guide which is capable of moving and the other edge guide is a fixed edge guide which may not be capable of moving. Since the first reflecting portion is provided in a position close to the fixed edge guide, it is not necessary to be concerned about the interference of the moveable edge guide, and the installation of the first reflecting portion becomes easy.

In the recording apparatus, the second tray may be provided with at least one edge guide which restricts a width of the recording medium and is capable of moving in a width direction, and the second reflecting portion may be disposed in a position which does not interfere with the edge guide.

In this case, it becomes possible to determine whether the recording medium is present or absent in two types of the second tray, the second tray which is provided with the center-meeting type edge guide which is provided with two moveable edge guides, and the second tray which is provided with a one side base-meeting type edge guide which is provided with only one moveable edge guide.

In other words, since the second reflecting portion is provided in a position outside of the movement region of the edge guide which is capable of moving, it is possible to use the edge guide by moving the edge guide to a position corresponding to the width of the recording medium which is set in the second tray, even if various widths of the recording medium are set in the second tray, and it is possible to easily perform the determination of whether the recording medium is present or absent in the second tray.

In the recording apparatus, the edge guide may be formed of a pair of edge guides, and the second reflecting portion may be disposed in a position between the edge guides which does not interfere with the edge guides.

In this case, it is possible to obtain the same operations and effects as in the fifth aspect in relation to the recording apparatus which is provided with the second tray in which a pair of edge guides are moveable edge guides which are capable of moving together.

In the recording apparatus, the second tray may include a moveable edge guide which restricts a width of the recording medium and is capable of moving in a width direction, and a fixed edge guide which is paired with the moveable edge guide and is not capable of moving, and the second reflecting portion may be provided in a position on the mounting surface outside of a movement region of the moveable edge guide, close to the fixed edge guide.

In this case, it is possible to obtain the same operations and effects as in any of the first to fourth aspects in relation to the recording apparatus which is provided with the second tray in which one edge guide is a moveable edge guide which is capable of moving and the other edge guide is a fixed edge guide which may not be capable of moving. Since the second reflecting portion is provided in a position close to the fixed edge guide, it is not necessary to be concerned about the interference of the moveable edge guide, and the installation of the second reflecting portion becomes easy.

The recording apparatus may further include a second tray detection sensor which detects the feeding position of the second tray.

In this case, it becomes possible to easily ascertain whether or not the second tray is positioned in the feeding position using the second tray detection sensor. Accordingly, it becomes possible to determine whether to execute the recording on the recording medium which is stored in the first tray or to execute the recording on the recording medium which is stored in the second tray, and it becomes possible to easily execute the determination of whether the recording medium is present or absent when executing the recording on the recording medium which is stored in the second tray.

The recording apparatus may further include a third reflecting portion which is provided below the first tray in a region which overlaps the first reflecting portion in a direction which orthogonally intersects the mounting surface.

In this case, it becomes possible to determine whether or not the trays are mounted using the optical sensor which is a medium detection sensor. Accordingly, it is possible to determine that neither the first tray nor the second tray is positioned in the feeding position when the optical sensor receives the reflected light from the third reflecting portion.

In the recording apparatus, the third reflecting portion may be provided on a support portion which supports the first tray from beneath.

In this case, since it is possible to install the third reflecting portion using the support portion, the installation of the third reflecting portion becomes easy.

In the recording apparatus, in the support portion, a protruding portion may be provided on a part which corresponds to a position of the third reflecting portion.

In this case, since the rigidity of the support portion is improved by providing the protruding portion on the support portion, the warping of the support portion as time passes is suppressed. By positioning the third reflecting portion on the protruding portion which has improved rigidity, the optical sensor can continually receive the reflected light from the third reflecting portion with good precision.

In the recording apparatus, in the second tray, using one end side in a movement direction as a fulcrum, another end side may be capable of pivoting in a direction which opens the first tray.

In this case, it is possible to open the first tray by pivoting the second tray in a predetermined direction. In other words, it is possible to greatly expose the first tray from a state in which the first tray is covered by the second tray. Accordingly, it becomes easy to set the recording medium in the first tray.

According to another aspect of the invention, there is provided a recording apparatus including: a recording head which executes recording on a recording medium; a first tray which stores a recording medium; a feed roller which is capable of feeding the recording medium in the first tray toward the recording head; at least one first moveable edge guide which is provided in the first tray, includes a restriction portion which restricts a width of the recording medium and a reception portion which receives a reverse surface of the recording medium, and is capable of moving in a width direction of the recording medium; a first reflecting portion which is provided such that at least a portion thereof is positioned in a region which is a mounting surface of the recording medium of the first tray, is within a width of a moveable region of the first moveable edge guide in a feed direction, and extends in the feed direction from the reception portion at a position at which the first moveable edge guide is at a minimum width; and an optical sensor which is provided above the mounting surface of the first reflecting portion in a direction which orthogonally intersects the mounting surface, in which the reception portion of the first moveable edge guide is configured such that detection light of the optical sensor is capable of reaching the first reflecting portion.

In this case, it is possible to ascertain the presence or absence of the recording medium which is stored in the first tray from the reflected light which is obtained from the detection light hitting the target object and returning, the detection light being radiated from the optical sensor.

Therefore, when the optical sensor receives the reflected light from the first reflecting portion, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

Since the first reflecting portion is provided on the mounting surface of the recording medium of the first tray in the moveable region of the first moveable edge guide, it is possible to perform the determination of whether the recording medium is present or absent in the first tray which is carried out by optical sensing using the moveable region of the moveable edge guide. Accordingly, it is possible to suppress the increase in size of the recording apparatus. It is possible to improve the degree of freedom of the disposition at which the first reflecting portion is provided.

According to still another aspect of the invention, there is provided a recording apparatus including: a recording head which executes recording on a recording medium, a first tray which stores a recording medium, a second tray which is positioned above the first tray, is capable of moving between a feeding position and a retraction position, and stores a recording medium, a feed roller which is capable of feeding the recording medium in the first tray and the recording medium in the second tray toward the recording head, at least one second moveable edge guide which is provided in the second tray, includes a restriction portion which restricts a width of the recording medium and a reception portion which receives a reverse surface of the recording medium, and is capable of moving in a width direction of the recording medium, a second reflecting portion which is provided such that at least a portion thereof is positioned in a region which is a mounting surface of the recording medium of the second tray, is within a width of a moveable region of the second moveable edge guide in a feed direction, and extends in the feed direction from the reception portion at a position at which the second moveable edge guide is at a minimum width, and an optical sensor which is provided above the mounting surface of the second reflecting portion in a direction which orthogonally intersects the mounting surface, in which the reception portion of the second moveable edge guide is configured such that detection light of the optical sensor is capable of reaching the second reflecting portion.

In this case, it is possible to ascertain the presence or absence of the recording medium which is stored in the second tray from the reflected light which is obtained from the detection light hitting the target object and returning, the detection light being radiated from the optical sensor.

Therefore, in the recording apparatus of the multi-level tray structure, when the optical sensor receives the reflected light from the second reflecting portion, it becomes possible to determine that the recording medium is absent from the second tray. Meanwhile, since the second reflecting portion is covered by the recording medium in the state in which the recording medium is present in the second tray, the optical sensor receives the reflected light from the recording medium, but not from the second reflecting portion. Accordingly, it is possible to determine that the recording medium is present in the second tray.

Since the second reflecting portion is provided on the mounting surface of the recording medium of the second tray in the moveable region of the second moveable edge guide, it is possible to perform the determination of whether the recording medium is present or absent in the second tray which is carried out by optical sensing using the moveable region of the moveable edge guide. Accordingly, it is possible to suppress the increase in size of the recording apparatus. It is possible to improve the degree of freedom of the disposition at which the second reflecting portion is provided.

The recording apparatus may further include a second tray which is positioned above the first tray, is capable of moving between a feeding position and a retraction position, and stores a recording medium, at least one second moveable edge guide which is provided in the second tray, includes a restriction portion which restricts a width of the recording medium and a reception portion which receives a reverse surface of the recording medium, and is capable of moving in a width direction of the recording medium, a second reflecting portion which is provided in a position which is a mounting surface of the recording medium of the second tray and which does not interfere with the second moveable edge guide, and an optical sensor which is provided above the mounting surface of the second reflecting portion in a direction which orthogonally intersects the mounting surface.

In this case, since the second reflecting portion is also provided in the second tray of the multi-level trays, it is possible to perform the determination of whether the recording medium is present or absent in the second tray using optical sensing.

The second reflecting portion is provided in a position which is the mounting surface of the recording medium of the second tray and does not interfere with the second moveable edge guide, that is, outside of the moveable region of the second moveable edge guide. Accordingly, it is no longer necessary to provide a cut-out portion (described later) in the reception portion of the second moveable edge guide which is provided in the second tray.

The recording apparatus may further include at least one first moveable edge guide which is provided in the first tray, includes a restriction portion which restricts a width of the recording medium and a reception portion which receives a reverse surface of the recording medium, and is capable of moving in a width direction of the recording medium, a first reflecting portion which is provided in a position which is a mounting surface of the recording medium of the first tray and which does not interfere with the first moveable edge guide, and an optical sensor which is provided above the mounting surface of the first reflecting portion in a direction which orthogonally intersects the mounting surface.

In this case, since the first reflecting portion is also provided in the first tray of the multi-level trays, it is possible to perform the determination of whether the recording medium is present or absent in the first tray using optical sensing.

The first reflecting portion is provided in a position which is the mounting surface of the recording medium of the first tray and does not interfere with the first moveable edge guide, that is, outside of the moveable region of the first moveable edge guide. Accordingly, it is no longer necessary to provide a cut-out portion (described later) in the reception portion of the first moveable edge guide which is provided in the first tray.

This structure is particularly effective when applied to the recording apparatus which is configured such that the width of the recording medium which is mounted in the second tray is smaller than the width of the recording medium which is mounted in the first tray.

The recording apparatus may further include a second tray which is positioned above the first tray, is capable of moving between a feeding position and a retraction position, and stores a recording medium; at least one second moveable edge guide which is provided in the second tray, includes a restriction portion which restricts a width of the recording medium and a reception portion which receives a reverse surface of the recording medium, and is capable of moving in a width direction of the recording medium; and a second reflecting portion which is provided such that at least a portion thereof is positioned in a mounting surface of the recording medium of the second tray in a moveable region of the second moveable edge guide, in which the feed roller is capable of feeding the recording medium which is in the second tray toward the recording head, the second reflecting portion is provided in a position which overlaps the first reflecting portion in a direction which orthogonally intersects the mounting surface in a state in which the second tray is positioned in the feeding position, and the reception portion of the second moveable edge guide is configured such that detection light of the optical sensor is capable of reaching the second reflecting portion.

In this case, when the optical sensor receives the reflected light from the first reflecting portion in a state in which the second tray is in the retraction position, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

When the second tray moves from the retraction position to the feeding position in order to perform the feeding using the shared feed roller, the first tray assumes a state of being shielded from the optical sensor by the second tray. In this state, when the optical sensor receives the reflected light from the second reflecting portion, it becomes possible to determine that the recording medium is absent from the second tray. Meanwhile, since the second reflecting portion is covered by the recording medium in the state in which the recording medium is present in the second tray, the optical sensor receives the reflected light from the recording medium, but not from the second reflecting portion.

Accordingly, it is possible to determine that the recording medium is present in the second tray.

In other words, in the recording apparatus which is provided with the multi-level trays which are capable of feeding the recording medium using the shared feed roller, it is possible to easily perform the determination of whether the recording medium is present or absent in each of the trays using the shared optical sensor.

The first reflecting portion is provided on the mounting surface of the recording medium of the first tray, in the moveable region of the first moveable edge guide. The second reflecting portion is provided on the mounting surface of the recording medium of the second tray, in the moveable region of the second moveable edge guide. Accordingly, it is possible to perform the determination of whether the recording medium is present or absent in each of the trays using optical sensing by using the moveable regions of each of the moveable edge guides. Therefore, it is possible to suppress the increase in size of the recording apparatus. It is possible to improve the degree of freedom of the disposition at which the first reflecting portion and the second reflecting portion are provided.

Even when the user forgets to set the recording medium or the like, the fact thereof is detected, and it is possible to preemptively prevent problems in the operation of the recording apparatus which would otherwise occur.

In the recording apparatus, the reception portion may be configured to include a cut-out portion such that detection light of the optical sensor is capable of reaching the reflecting portions due to the cut-out portion.

Here, the term "cut-out portion" means a structure in a state in which the member which forms the reception portion is absent from a part of the reception portion which corresponds to the reflecting portion, and is not limited to a structure which is formed by literally removing a part which corresponds to the reception portion, and a structure which is formed at the formation stage is also included in a "cut-out portion". It is also possible to refer to the cut-out portion in another manner as an "escape portion".

In this case, it is possible to realize a configuration in which a simple structure is adopted and the detection light of the optical sensor is capable of reaching the reflecting portion.

In the recording apparatus, the reception portion may be configured such that at least a part thereof which corresponds to detection light is optically transparent, and the detection light of the optical sensor is capable of reaching the reflecting portions due to the optical transparency.

Here, the term "optical transparency" means that the reception portion is configured of a material which is capable of transmitting the detection light of the optical sensor, the transmittance thereof may be a transmittance at which it is possible to discern the reflected light from the reflecting portion, the invention is not limited to a colorless transparent member, and the member may be translucent.

In this case, it is possible to realize a configuration in which a simple structure is adopted and the detection light of the optical sensor is capable of reaching the reflecting portion.

According to still another aspect of the invention, there is provided a recording apparatus including: a recording head which executes recording on a recording medium; a first tray which stores a recording medium; a feed roller which is capable of feeding the recording medium in the first tray toward the recording head; a first reflecting portion which is provided on a mounting surface of the recording medium of the first tray; an optical sensor which is provided above the mounting surface of the first reflecting portion in a direction which orthogonally intersects the mounting surface; and a tray detection reflecting portion which is provided below the first tray in a region which overlaps the first reflecting portion in a direction which orthogonally intersects the mounting surface.

In this case, it is possible to ascertain the presence or absence of the recording medium which is stored in the first tray from the reflected light which is obtained from the detection light hitting the target object and returning, the detection light being radiated from the optical sensor.

Therefore, when the optical sensor receives the reflected light from the first reflecting portion, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

When the optical sensor receives the reflected light from the tray detection reflecting portion, it is possible to determine that the first tray is not in a position at which it is possible to execute the recording. In this case, the first tray which can be inserted and removed is either not inserted to the correct position in the recording apparatus, or is removed.

Since the user can obtain the information described above, the usability of the recording apparatus is improved.

In other words, it is possible to perform the determination of whether the recording medium is present or absent in the first tray and the determination of the insertion or removal state of the first tray to the recording apparatus using the shared optical sensor.

According to still another aspect of the invention, there is provided a recording apparatus including: a recording head which executes recording on a recording medium; a first tray which stores a recording medium; a second tray which is positioned above the first tray, is capable of moving between a feeding position and a retraction position, and stores a recording medium; a feed roller which is capable of feeding the recording medium in the first tray and the recording medium in the second tray toward the recording head; a second reflecting portion which is provided on a mounting surface of the recording medium of the second tray; an optical sensor which is provided above the mounting surface of the second reflecting portion in a direction which orthogonally intersects the mounting surface in a state in which the second tray is in the feeding position; and a tray detection reflecting portion which is provided below the first tray in a region which overlaps the second reflecting portion in a direction which orthogonally intersects the mounting surface.

In this case, it is possible to ascertain the presence or absence of the recording medium which is stored in the second tray from the reflected light which is obtained from the detection light hitting the target object and returning, the detection light being radiated from the optical sensor.

Therefore, in the recording apparatus of the multi-level tray structure, when the second tray moves from the retraction position to the feeding position in order to perform the feeding using the shared feed roller, the first tray assumes a state of being shielded from the optical sensor by the second tray. In this state, when the optical sensor receives the reflected light from the second reflecting portion, it becomes possible to determine that the recording medium is absent from the second tray. Meanwhile, since the second reflecting portion is covered by the recording medium in the state in which the recording medium is present in the second tray, the optical sensor receives the reflected light from the recording medium, but not from the second reflecting portion. Accordingly, it is possible to determine that the recording medium is present in the second tray.

When the optical sensor receives the reflected light from the tray detection reflecting portion, neither the first tray nor the second tray is present in a position at which the detection light of the optical sensor hits. In this case, the first tray which can be inserted and removed is either not inserted to the correct position in the recording apparatus, or is removed. The second tray which can be inserted and removed is either positioned in the retraction position, or not inserted to the correct position in the recording apparatus, or is removed.

Since the user can obtain the information described above, the usability of the recording apparatus is improved.

In other words, it is possible to perform the determination of whether the recording medium is present or absent in the first tray and the determination of the insertion or removal state of the first tray to the recording apparatus using the shared optical sensor.

The recording apparatus may further include a second tray detection sensor which detects the feeding position of the second tray.

In this case, it becomes possible to easily ascertain whether or not the second tray is positioned in the feeding position using the second tray detection sensor. Accordingly, it becomes possible to determine whether to execute the recording on the recording medium which is stored in the first tray or to execute the recording on the recording medium which is stored in the second tray, and it becomes possible to easily execute the determination of whether the recording medium is present or absent when executing the recording on the recording medium which is stored in the second tray.

The recording apparatus may further include a first reflecting portion which is provided on the mounting surface of the recording medium of the first tray.

In this case, it becomes possible to use the first reflecting portion which is provided on the mounting surface of the recording medium of the first tray, and when an optical sensor is used to detect the reflected light from the first reflecting portion, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

In the recording apparatus, the first reflecting portion may overlap the second reflecting portion in a direction which orthogonally intersects the mounting surface in a state in which the second tray is moved to the feeding position.

In this case, when the optical sensor receives the reflected light from the first reflecting portion in a state in which the second tray is in the retraction position, it becomes possible to determine that the recording medium is absent from the first tray. Meanwhile, since the first reflecting portion is covered by the recording medium in the state in which the recording medium is present in the first tray, the optical sensor receives the reflected light from the recording medium, but not from the first reflecting portion. Accordingly, it is possible to determine that the recording medium is present in the first tray.

When the second tray moves from the retraction position to the feeding position in order to perform the feeding using the shared feed roller, the first tray assumes a state of being shielded from the optical sensor by the second tray. In this state, when the optical sensor receives the reflected light from the second reflecting portion, it becomes possible to determine that the recording medium is absent from the second tray. Meanwhile, since the second reflecting portion is covered by the recording medium in the state in which the recording medium is present in the second tray, the optical sensor receives the reflected light from the recording medium, but not from the second reflecting portion.

Accordingly, it is possible to determine that the recording medium is present in the second tray.

In other words, in the recording apparatus which is provided with the multi-level trays which are capable of feeding the recording medium using the shared feed roller, it is possible to easily perform the determination of whether the recording medium is present or absent in each of the trays using the shared optical sensor.

It is possible to determine that neither the first tray nor the second tray is positioned in the feeding position when the optical sensor receives the reflected light from the tray detection reflecting portion. In other words, the first tray and the second tray which can be inserted and removed are not inserted to the correct position in the recording apparatus or are removed, and the second tray is positioned in the retraction position.

Since the user can obtain the information described above, the usability of the recording apparatus is improved.

In other words, it is possible to perform the determination of whether the recording medium is present or absent in the first tray, the determination of whether the recording medium is present or absent in the second tray, and the determination of the insertion or removal state of each of the trays to the recording apparatus using the shared optical sensor.

In the recording apparatus, the tray detection reflecting portion may be provided on a support portion which supports the first tray from below, and the support portion may include a protruding portion in a higher position than an installation surface of the recording apparatus which makes contact with the installation surface on the installation surface side.

In this case, since it is possible to install the tray detection reflecting portion using the support portion, the installation of the tray detection reflecting portion becomes easy. Since the support portion is provided with the protruding portion which makes contact with the installation surface on the installation surface side, the rigidity of the support portion is improved by the protruding portion, and the warping of the support portion as time passes is suppressed.

In the recording apparatus, the protruding portion may be provided in a position corresponding a position of the tray detection reflecting portion of the support portion.

In this case, since the protruding portion is provided on a part which corresponds to the position of the tray detection reflecting portion of the support portion, it is possible to continuously receive the reflected light from the tray detection reflecting portion with good precision.

BRIEF DESCRIPTION OF THE DRAWINGS

The invention will be described with reference to the accompanying drawings, wherein like numbers reference like elements.

FIG. 9A is a vertical cross-sectional front diagram of a case in which the recording medium is fed from the second tray, and FIG. 9B is a vertical cross-sectional front diagram of a case in which the recording medium is fed from the first tray.

DESCRIPTION OF EXEMPLARY EMBODIMENTS

Hereinafter, detailed description will be given of a recording apparatus according to the invention with reference to the attached drawings.

Figure 1:
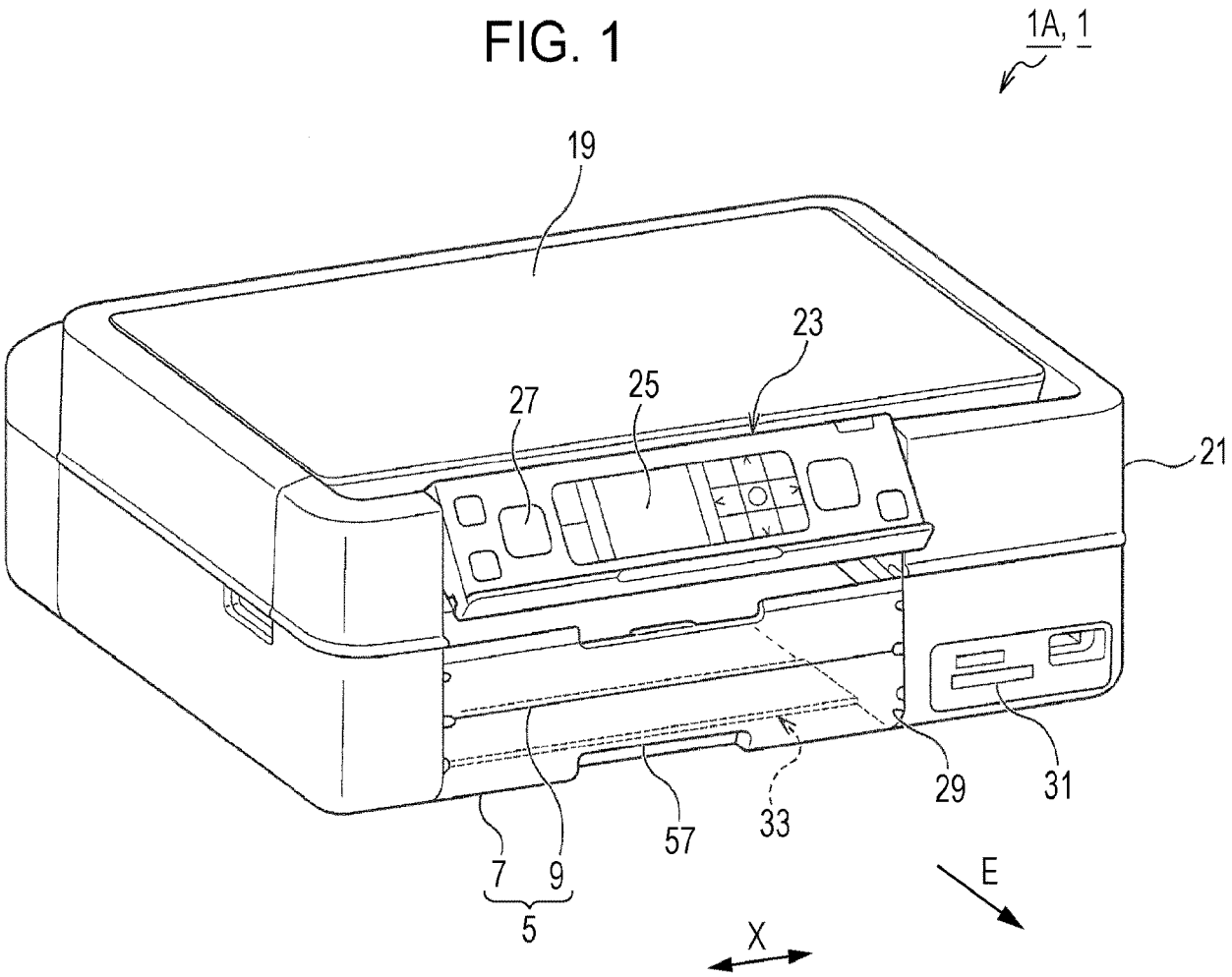
FIG. 1 is an external appearance perspective view illustrating a recording apparatus according to a first embodiment of the invention.

In the description hereinafter, first, using a recording apparatus according to the first embodiment as an example, a description will be given of the outline of the overall configuration of the recording apparatus according to the invention based on FIGS. 1 to 3, and next, description will be given of the specific configuration and operations of a multi-level tray and related members based on FIGS. 4 to 9B.

Additionally, description will be given of an example of a state distinction method which is performed based on a threshold by the optical sensor according to the invention based on FIG. 10, and description will be given of an example of the control of the recording apparatus based on the detection of whether or not the multi-level tray is mounted, the detection of the position of a second tray, and the detection of whether or not a recording medium is present in each tray based on FIG. 11.

Next, description will be given of a recording apparatus according to a second embodiment based on FIGS. 12 to 15 centered on the differences in the configuration and operations of the multi-level tray in relation to the first embodiment.

Description will be given of the configuration, restricted to the configuration of the multi-level tray, of a recording apparatus according to a third embodiment of the invention based on FIGS. 16 to 18 centered on the differences in relation to the first embodiment.

Description will be given of the configuration of a recording apparatus according to another embodiment of the invention based on FIG. 19 centered on the differences in relation to the first embodiment, and description will be given of the configuration, restricted to the configuration of the multi-level tray, of a recording apparatus according to still another embodiment of the invention based on FIG. 20 centered on the differences in relation to the first embodiment.

First Embodiment (Refer to FIGS. 1 to 11)

A recording apparatus 1 according to the first embodiment of the invention is provided with a recording head 3, a multi-level tray 5, and a feed roller 11. The recording head 3 executes the recording in relation to the recording medium (hereinafter also referred to as the "paper"), the multi-level tray 5 includes a first tray 7 and a second tray 9 which store paper P, and the feed roller 11 is capable of feeding the paper P within the first tray 7 and the paper P within the second tray 9 toward the recording head 3. Generally, the recording apparatus 1 is configured by being provided with a first reflecting portion 13 and an optical sensor 17. The first reflecting portion 13 is provided on a mounting surface 7*a* of the paper P of the first tray 7, and the optical sensor 17 is provided above the mounting surface 7*a* of the first reflecting portion 13 in the direction Z which orthogonally intersects the mounting surface 7*a*.

In the present embodiment, the recording apparatus 1 is provided with at least one first moveable edge guide 43. The first moveable edge guide 43 is capable of moving in the width direction X of the paper P, is provided on the first tray 7, and includes a restriction portion 43*a* which restricts the width of the paper P, and a reception portion 43*b* which receives the reverse surface of the paper P.

In the present embodiment, the first reflecting portion 13 is provided such that at least a portion thereof is positioned in a region which is the mounting surface 7*a* of the paper P of the first tray 7, is within the width of the first moveable edge guide 43 in the feed direction, and extends in the feed direction from the reception portion 43*b* at a position at which the first moveable edge guide 43 is at the minimum width. Corresponding to this configuration, the reception portion 43*b* of the first moveable edge guide 43 is configured such that the detection light of the optical sensor 17 is capable of reaching the first reflecting portion 13.

Note that, it is possible to provide the first reflecting portion 13 outside of the moveable region of the first moveable edge guide 43, that is, in a position which does not interfere with the first moveable edge guide 43.

In addition to the configuration described above, the recording apparatus 1 according to the present embodiment is provided with the second tray 9 and a second reflecting portion 15. The second tray 9 is positioned above the first tray 7, is capable of moving to a feeding position F and a retraction position R, and stores the paper P, and the second reflecting portion 15 is provided on a mounting surface 9*a* in which the paper P of the second tray 9 is mounted.

In the present embodiment, the recording apparatus 1 is provided with at least one second moveable edge guide 63 which is capable of moving in the width direction X of the paper P, is provided on the second tray 9, and includes a restriction portion 63*a* which restricts the width of the paper P, and a reception portion 63*b* which receives the reverse surface of the paper P.

In the present embodiment, the second reflecting portion 15 is provided such that at least a portion thereof is positioned in a region which is the mounting surface 9*a* of the paper P of the second tray 9, is within the width of the second moveable edge guide 63 in the feed direction, and extends in the feed direction from the reception portion 63*b* at a position at which the second moveable edge guide 63 is at the minimum width. Corresponding to this configuration, the reception portion 63*b* of the second moveable edge guide 63 is configured such that the detection light of the optical sensor 17 is capable of reaching the second reflecting portion 15.

Note that, it is possible to provide the second reflecting portion 15 outside of the moveable region of the second moveable edge guide 63, that is, in a position which does not interfere with the second moveable edge guide 63.

In the present embodiment, it is possible to feed the paper P within the second tray 9 toward the recording head 3 using the feed roller 11 which is shared with the first tray 7 described earlier.

Figure 3:
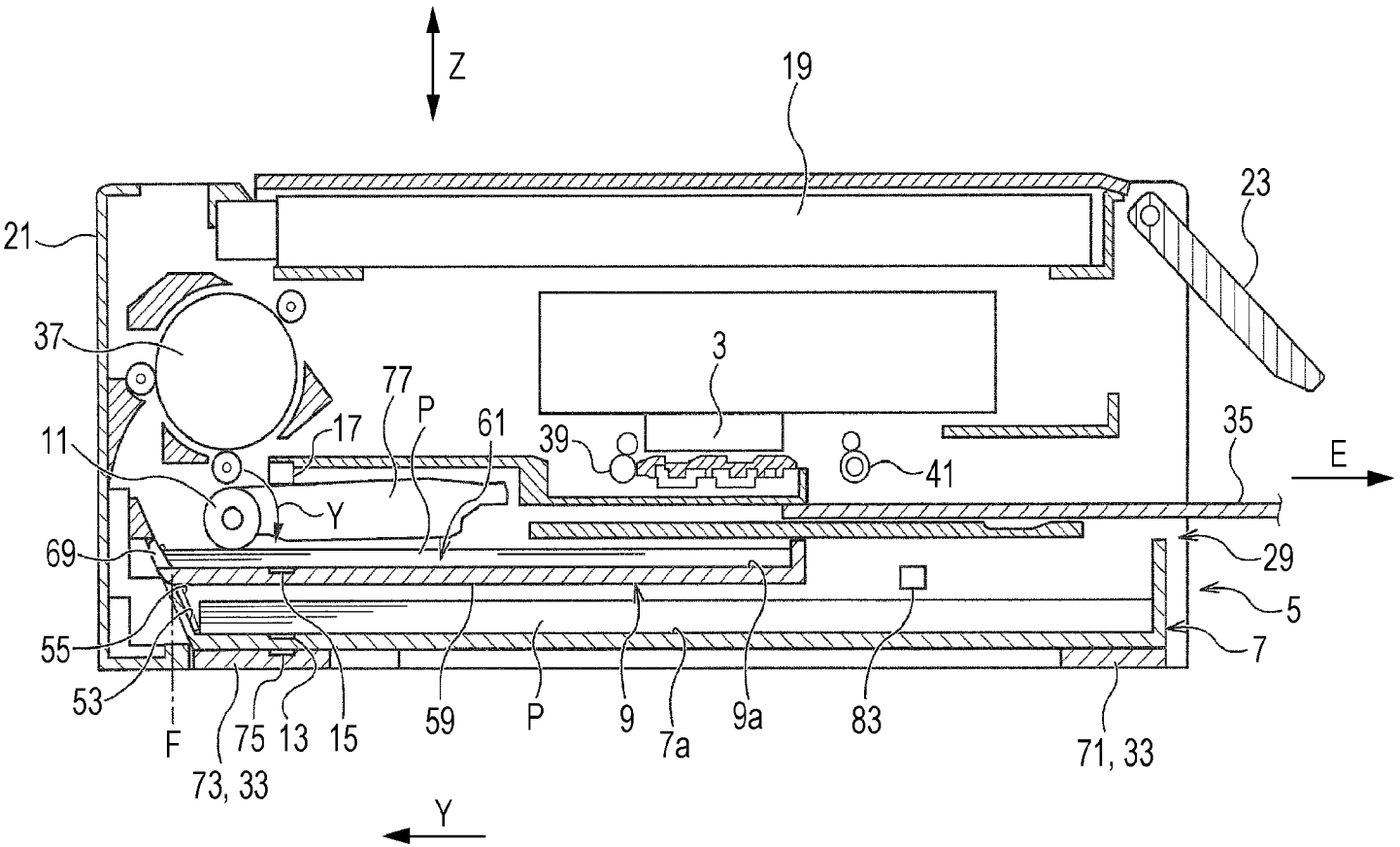
FIG. 3 is a side cross-sectional diagram illustrating the recording apparatus according to the first embodiment of the invention when feeding the recording medium from a second tray.

As illustrated in FIG. 3, the second reflecting portion 15 is provided in a position which overlaps the first reflecting portion 13 in the direction Z which orthogonally intersects the mounting surface 9*a* in a state in which the second tray 9 is positioned in the feeding position F. In other words, the first reflecting portion 13 is provided in a position which overlaps the second reflecting portion 15 in the direction Z which orthogonally intersects the mounting surface 9*a* in a state in which the second tray 9 is positioned in the feeding position F.

The reception portion 63*b* of the second moveable edge guide 63 is configured in the same manner as the reception portion 43*b* of the first moveable edge guide 43 such that the detection light of the optical sensor 17 is capable of reaching the second reflecting portion 15.

The recording apparatus 1 is provided with a tray detection reflecting portion 75 which is a region which overlaps the first reflecting portion 13 in the direction Z which orthogonally intersects the mounting surface 7*a*, and is provided below the first tray 7 which is the third reflecting portion.

Of the aforementioned configurations, a characteristic configuration of the present embodiment is the positional relationship between the first reflecting portion 13, the second reflecting portion 15, and the optical sensor 17.

Another characteristic configuration is the positional relationship between the first reflecting portion 13, the second reflecting portion 15, the first moveable edge guide 43, the second moveable edge guide 63, and the optical sensor 17.

Another characteristic configuration is the positional relationship between the first reflecting portion 13, the second reflecting portion 15, the tray detection reflecting portion 75, and the optical sensor 17.

In the description given above, the second reflecting portion 15 is described as a component which is added to a structure in which the first reflecting portion 13 is provided on the mounting surface 7*a* of the first tray 7; however, it is also possible to adopt a structure in which the first reflecting portion 13 is not provided on the first tray 7.

When this structure is adopted, it is possible to describe the recording apparatus 1 as being provided with the second tray 9, the feed roller 11, the second reflecting portion 15, the optical sensor 17, and the tray detection reflecting portion 75, where the second tray 9 is positioned above the first tray 7, is capable of moving to the feeding position F and the retraction position R, and stores the paper P, the feed roller 11 is capable of feeding the paper P within the first tray 7 and the paper P within the second tray 9 toward the recording head 3, the second reflecting portion 15 is provided on the mounting surface 9*a* of the paper P of the second tray 9, the optical sensor 17 is provided above the mounting surface 9*a* of the second reflecting portion 15 in the direction Z which orthogonally intersects the mounting surface 9*a* in a state in which the second tray 9 is in the feeding position F, and the tray detection reflecting portion 75 is a region which overlaps the second reflecting portion 15 in the direction Z which orthogonally intersects the mounting surface 9*a* and is provided below the first tray 7.

1. Configuration of Outline of Recording Apparatus (Refer to FIGS. 1 to 3)

First, a description will be given of the outline of the overall configuration of a recording apparatus 1A according to the first embodiment based on FIGS. 1 to 3.

The recording apparatus 1A depicted in the drawings is a multifunction ink jet printer in which a scanner unit 19 is disposed on the top portion of the recording apparatus 1A. An operation panel 23 is attached to the top portion of the front surface of a recording apparatus main body 21. The operation panel 23 is capable of pivoting upward from the front around a rotational fulcrum provided on the front edge. A display unit 25 and an operation unit 27 are disposed on the operation panel 23. The display unit 25 displays various information, setting content, and the like, and the operation unit 27 is for executing various operations or inputting setting content.

An opening portion 29 is formed in the front surface of the recording apparatus main body 21 below the operation panel 23. The opening portion 29 is for mounting the multi-level tray 5, which is formed by providing the first tray 7 and the second tray 9, to the recording apparatus main body 21, or alternatively, for outputting the paper P to the outside after the execution of the printing, or the like. A connecting portion 31 for connecting to an external device is disposed on the right side of the opening portion 29, as viewed facing the opening portion 29.

There is a top region and a bottom region within the recording apparatus main body 21, and of these, various members are disposed in the bottom region, including a support portion 33, the first tray 7, the second tray 9, the feed roller 11, an output tray 35, and the optical sensor 17. The support portion 33 supports the multi-level tray 5 which is mounted thereto, the first tray 7 is disposed on the bottom level, the second tray is disposed on the top level, the feed roller 11 is for feeding the paper P within each of the trays 7 and 9 toward the recording head 3 side, the output tray 35 adopts a drawer system, for example, and receives the paper P which is output to the outside of the recording apparatus main body 21 after the execution of the printing, and the optical sensor 17 is for detecting whether the paper P is present or absent, or the like.

Meanwhile, an intermediate roller 37, a transport roller 39, an output roller 41, and the like are disposed in the top region. The intermediate roller 37 is for inverting and guiding the paper P which is fed by the feed roller 11 toward the recording head 3, the transport roller 39 is formed of a pair of nip rollers for transporting the paper P which is guided by the intermediate roller 37 toward the recording execution region in which the recording head 3 is present, and the output roller 41 is similarly formed for a pair of nip rollers for outputting the paper P to the outside after the execution of the printing.

Figure 2:
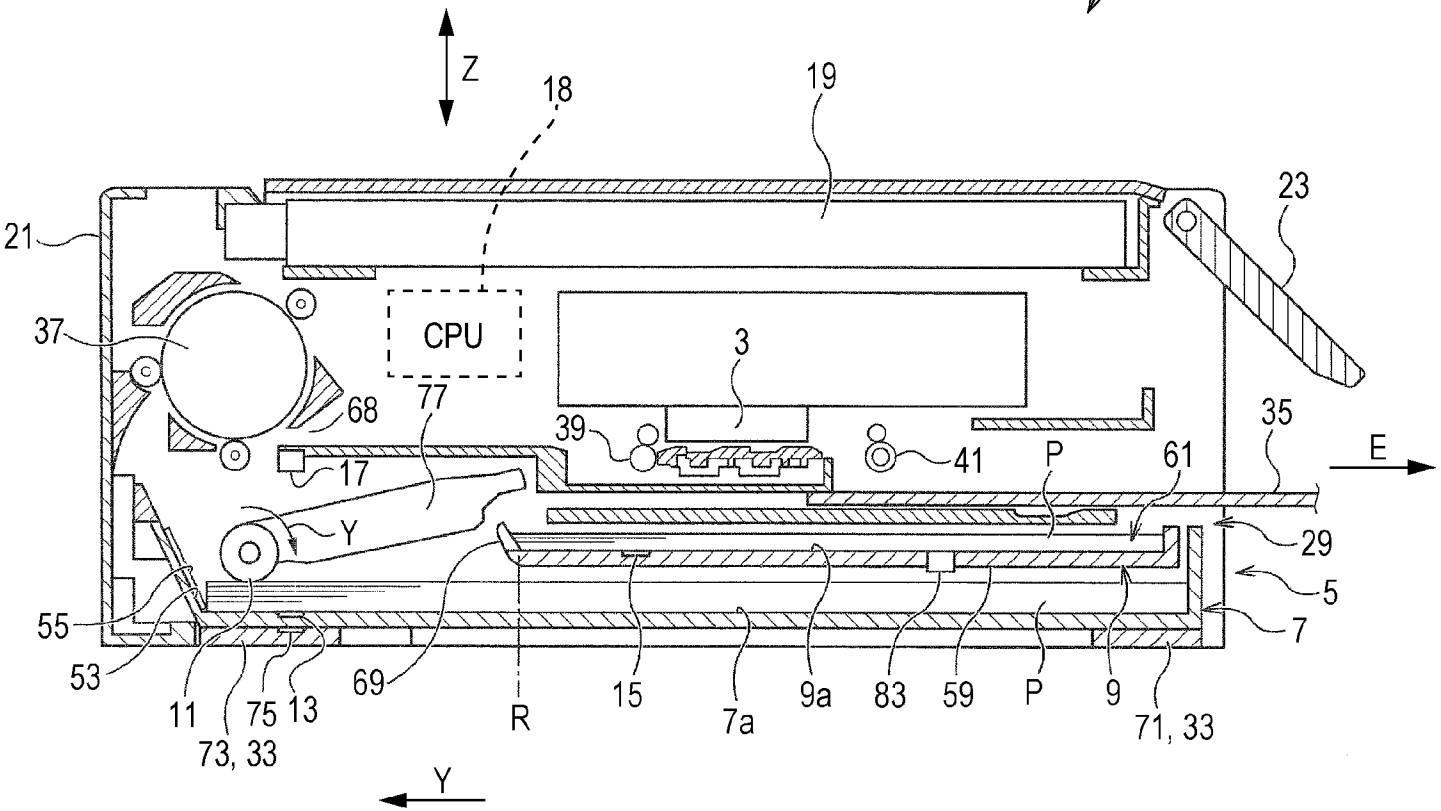
FIG. 2 is a side cross-sectional diagram illustrating the recording apparatus according to the first embodiment of the invention when feeding a recording medium from a first tray.

In the recording apparatus 1, in order to record on the reverse surface of the paper P, the paper P in which the obverse surface has been subjected to recording is caused to reverse by the output roller 41 and the transport roller 39 which are driven in reverse rotation, and the paper P is guided to the intermediate roller 37 via an inverted recording return path 68 (FIG. 2). The paper P is inverted by the intermediate roller 37, and the recording is executed on the reverse surface of the paper P. Accordingly, the duplex recording is executed.

The optical sensor 17 is disposed on the reverse side of an inverted recording return path 68 within the recording apparatus main body 21.

2. Specific Configuration and Operations of Multi-Level Tray and Related Members (Refer to FIGS. 4 to 9B).

Figure 4:
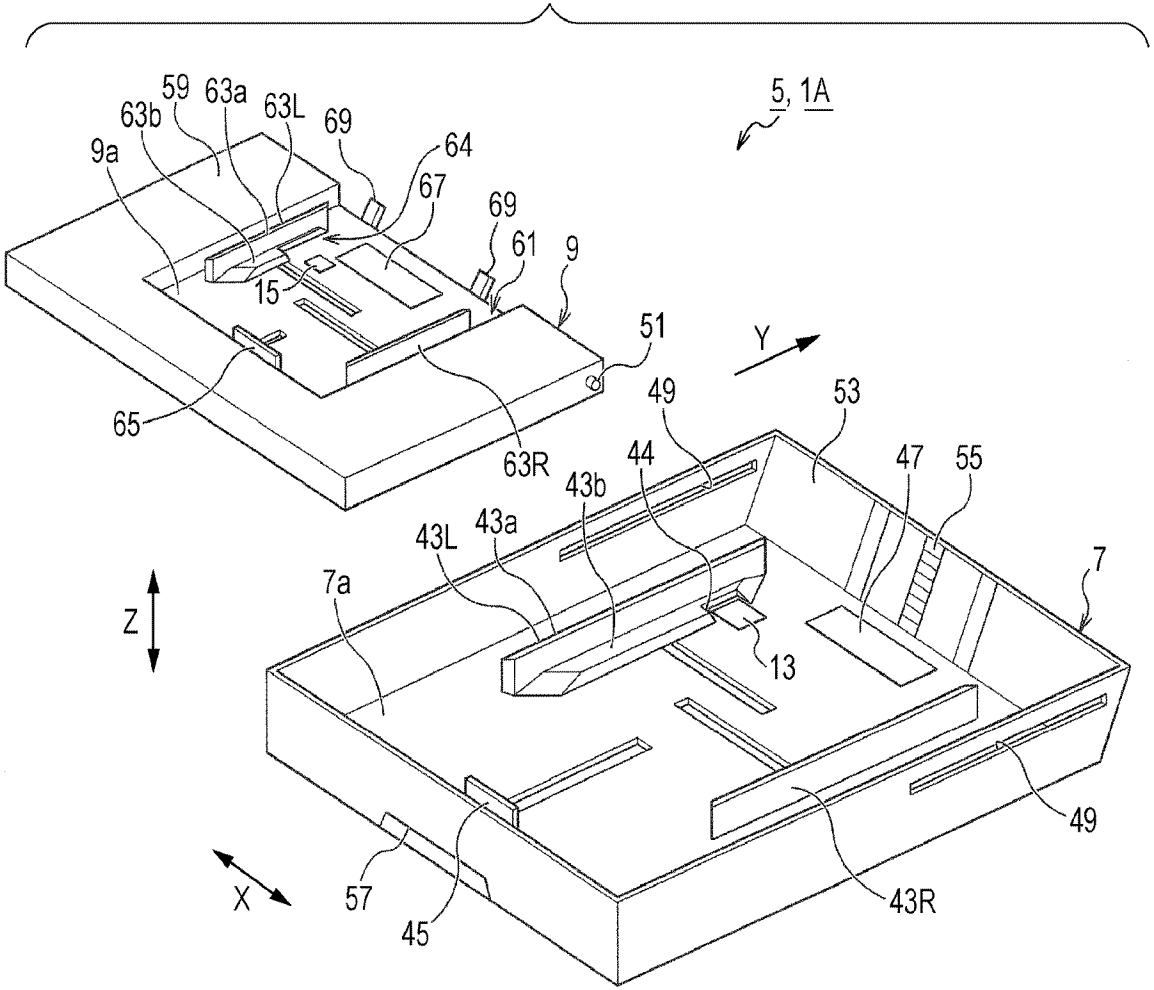
FIG. 4 is a perspective view illustrating a multi-level tray of the recording apparatus according to the first embodiment of the invention in a dismantled state.

As described earlier, in the present embodiment, the multi-level tray 5 is configured to include two trays, the first tray 7 which is disposed on the bottom level, and the second tray 9 which is disposed on the top level. Of the two trays, the first tray 7 is a member with the shape of a container with a shallow bottom in which the front surface, the rear surface, and the left and right side surfaces are surrounded by walls as illustrated in FIG. 4. A pair of first moveable edge guides 43L and 43R, a front end edge guide 45, a friction sheet 47, and a first reflecting portion 13 are disposed on the bottom surface of the first tray 7. The first moveable edge guides 43L and 43R are a center-meeting type left-right pair, which is an example of a member which restricts the width of the paper P, the front end edge guide 45 restricts the position of the paper P in the length direction, the friction sheet 47 is for preventing double feeding of the paper P, the first reflecting portion 13 reflects the emitted light, and the bottom surface is the mounting surface 7A of the paper P.

The first moveable edge guides 43L and 43R move in tandem with each other and restrict the width of the paper P with the mounting surface 7*a* centered therebetween.

As illustrated in FIG. 4, a cut-out portion 44 is formed, at a position close to the feed direction Y, in the reception portion 43*b* of the first moveable edge guide 43L of the left side which abuts the edge of the left end of the paper P. The cut-out portion 44 has a rectangular concave shape, for example.

By forming the cut-out portion 44 in the reception portion 43*b*, it is possible to detect whether the paper P is present or absent within the first tray 7 even when the first moveable edge guide 43L is moved to the extreme of the moveable region of the inside so as to render the width of the first moveable edge guides 43L and 43R the minimum width, and the reception portion 43*b* of the first moveable edge guide 43L reaches a position which overlaps the first reflecting portion 13. The detection light which is radiated from the optical sensor 17 reaches the first reflecting portion 13 which is positioned to face the cut-out portion 44 without being blocked by the reception portion 43*b*.

Figure 7:
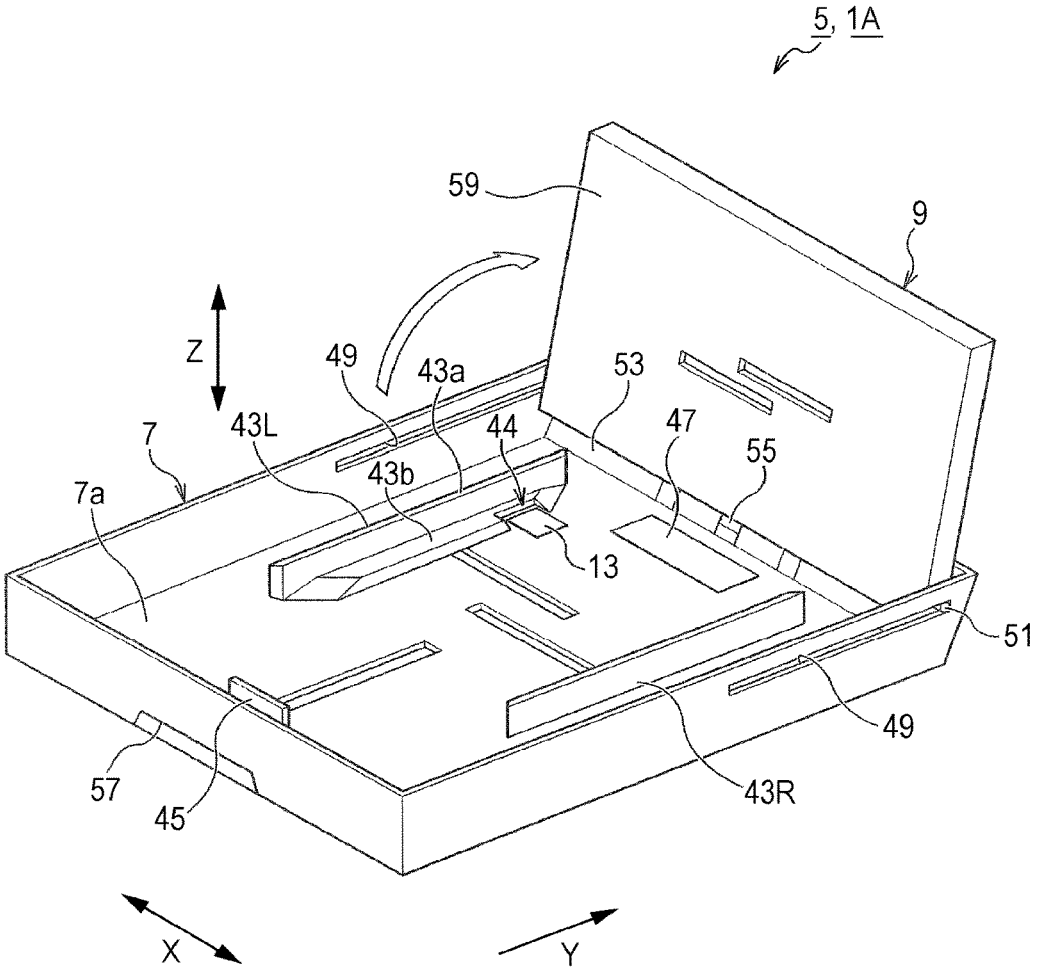
FIG. 7 is a perspective view illustrating the multi-level tray of the recording apparatus according to the first embodiment of the invention in an assembled state when the second tray is pivoted to open the first tray.

A slide groove 49 which extends along the feed direction Y of the paper P is formed on each of the left and right sides of the first tray 7. Short circular rod-shaped slide protrusions 51 engage with the slide grooves 49 in a state of being capable of sliding in the feed direction Y and capable of pivoting the second tray 9 to the inner portion side. The slide protrusions 51 are an example of members which are provided on the left and right side surfaces of the second tray 9 (described later) close to the rear end parts thereof. Accordingly, as illustrated in FIG. 7, the second tray 9 is configured such that the other end side is capable of pivoting in a direction which opens the second tray 9, using the slide protrusions 51 which are provided on the first end side as a fulcrum.

The rear surface of the first tray 7 which is downstream in the feed direction Y is a guide inclined surface 53 which guides the feeding of the paper P, and a separation inclined surface 55 which separates the paper P of the top position from the paper P of a lower position is provided, for example, in the middle of the guide inclined surface 53. In addition, a grip portion 57, which is used when attaching or detaching the first tray 7 in relation to the recording apparatus main body 21, is provided on the front surface of the first tray 7.

Meanwhile, as illustrated in FIG. 4, the second tray 9 is provided with a plate-shaped tray main body 59, and a concave portion 61 is formed in the top surface of the tray main body 59. The concave portion 61 has a shallow bottom which is shallower than the first tray 7 which serves as the storage space of the paper P. As described above, a pair of second moveable edge guides 63L and 63R, a front end edge guide 65, a friction sheet 67, and a second reflecting portion 15 are disposed on the bottom surface of the concave portion 61 which serves as the mounting surface 9*a* of the paper P. The second moveable edge guides 63L and 63R left-right pair similar to the one in the first tray 7 described earlier, and the second reflecting portion 15 reflects the emitted light.

Figure 6:
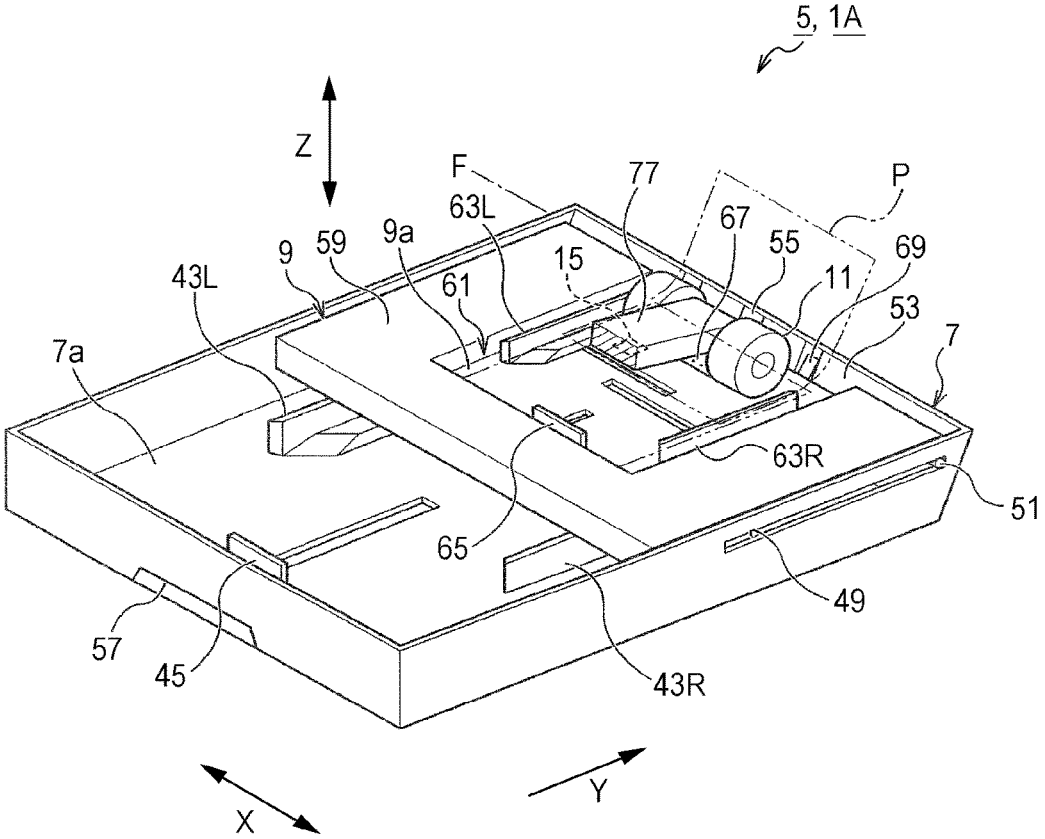
FIG. 6 is a perspective view illustrating the multi-level tray of the recording apparatus according to the first embodiment of the invention in an assembled state when feeding the recording medium from the second tray.

The downstream end of the concave portion 61 in the feed direction Y is open, and a stopper 69 is provided on the open downstream end in an inclined state in order to prevent the stacked paper P from collapsing. As illustrated in FIG. 6, the stopper 69 enters further inward than the separation inclined surface 55 in a state in which the second tray 9 is moved to the feeding position F, and a state is assumed in which the leading end of the paper P which is stored in the second tray 9 is capable of abutting the separation inclined surface 55.

The second moveable edge guides 63L and 63R move in tandem with each other and restrict the width of the paper P with the mounting surface 9*a* centered therebetween.

As illustrated in FIG. 4, a cut-out portion 64 is formed in the reception portion 63*b* of the second moveable edge guide 63L of the left side which abuts the edge of the left end of the paper P. The cut-out portion 64 is cut out in an L-shape, for example, in a position close to the feed direction Y.

By forming the cut-out portion 64 in the reception portion 63*b*, it is possible to detect whether the paper P is present or absent within the second tray 9 even when the second moveable edge guide 63L is moved to the extreme of the moveable region of the inside so as to render the width of the second moveable edge guides 63L and 63R the minimum width, and the reception portion 63*b* of the second moveable edge guide 63L reaches a position which overlaps the second reflecting portion 15. The detection light which is radiated from the optical sensor 17 reaches the second reflecting portion 15 which is positioned to face the cut-out portion 64 without being blocked by the reception portion 63*b*.

Figure 8:
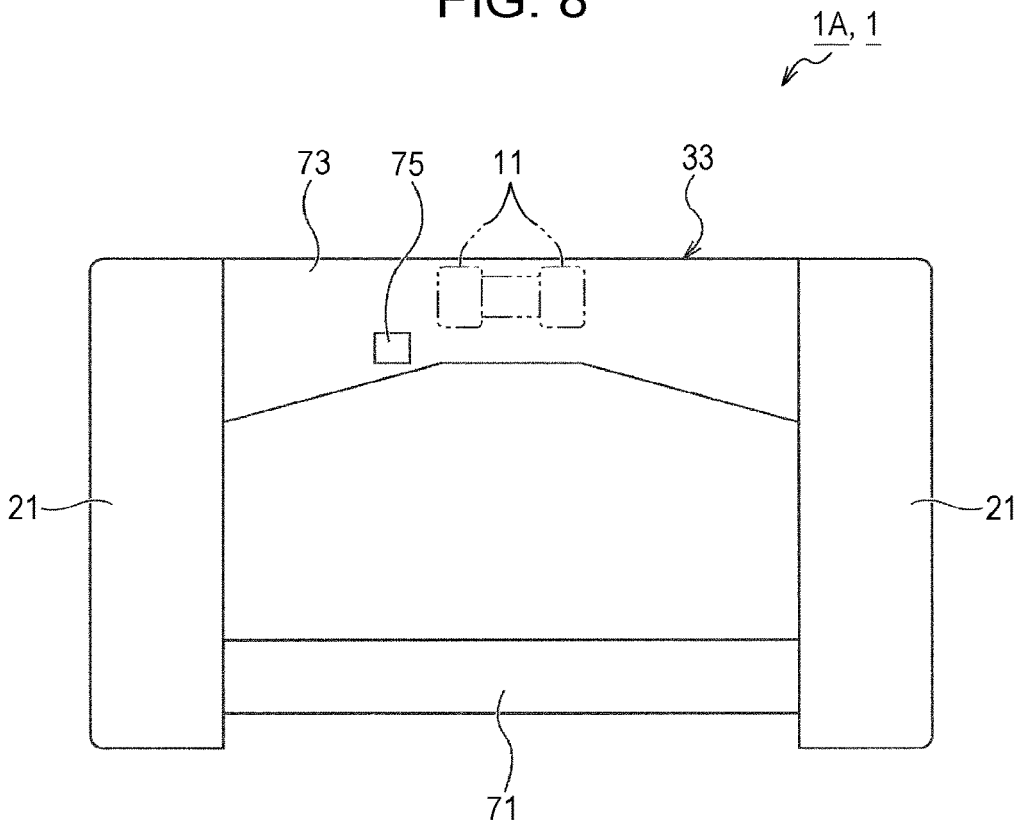
FIG. 8 is a schematic plan diagram illustrating a support portion which supports the first tray of the recording apparatus according to the first embodiment of the invention.

As illustrated in FIG. 8, the support portion 33 which supports the multi-level tray 5 which is configured in this manner is formed in the center of the bottom portion of the recording apparatus main body 21. The support portion 33 is formed of two plate-shaped tray support portions, for example, a front-side tray support portion 71 and a rear-side tray support portion 73, and of these, the tray detection reflecting portion 75 (described later) which reflects the emitted light is disposed on the rear-side tray support portion 73. The tray detection reflecting portion 75 is also the third reflecting portion.

Next, description will be given of the specific configuration of the optical sensor 17, the first reflecting portion 13, the second reflecting portion 15, and the tray detection reflecting portion 75 which are described earlier, and the positional relationship between the aforementioned members and the cut-out portions 44 and 64.

The optical sensor 17 is a sensor which detects whether the paper P which is stored in the first tray 7 and the second tray 9 is present or absent, and whether the first tray 7 and the second tray 9 are mounted or not. In the present embodiment, a reflection system optical sensor in which light which is radiated from a light emitting element hits a target object, the optical sensor detects the reflectance of the light which returns after reflecting on the target object, and the optical sensor identifies the differences in the target objects.

The first reflecting portion 13, the second reflecting portion 15, and the tray detection reflecting portion 75 are each a member with a different reflectance from the others such that it is possible to identify the differences in the target objects, and aspects of the formation thereof include an aspect in which a reflective sheet is bonded thereto, an aspect in which coatings with different reflectance properties (for example, color) are applied thereto, an aspect in which the roughness of the obverse surface of the base material of the formation part is varied so as to cause the reflectance to differ, or the like may be adopted.

It is possible to set the reflectance of the aforementioned members such that it is possible to clearly detect whether the paper P is present or absent, and such that the difference between the reflectance of the aforementioned members and the reflectance of the paper P is great. Note that, with regard to this point, more detailed description will be given later based on FIG. 10.

Figure 5:
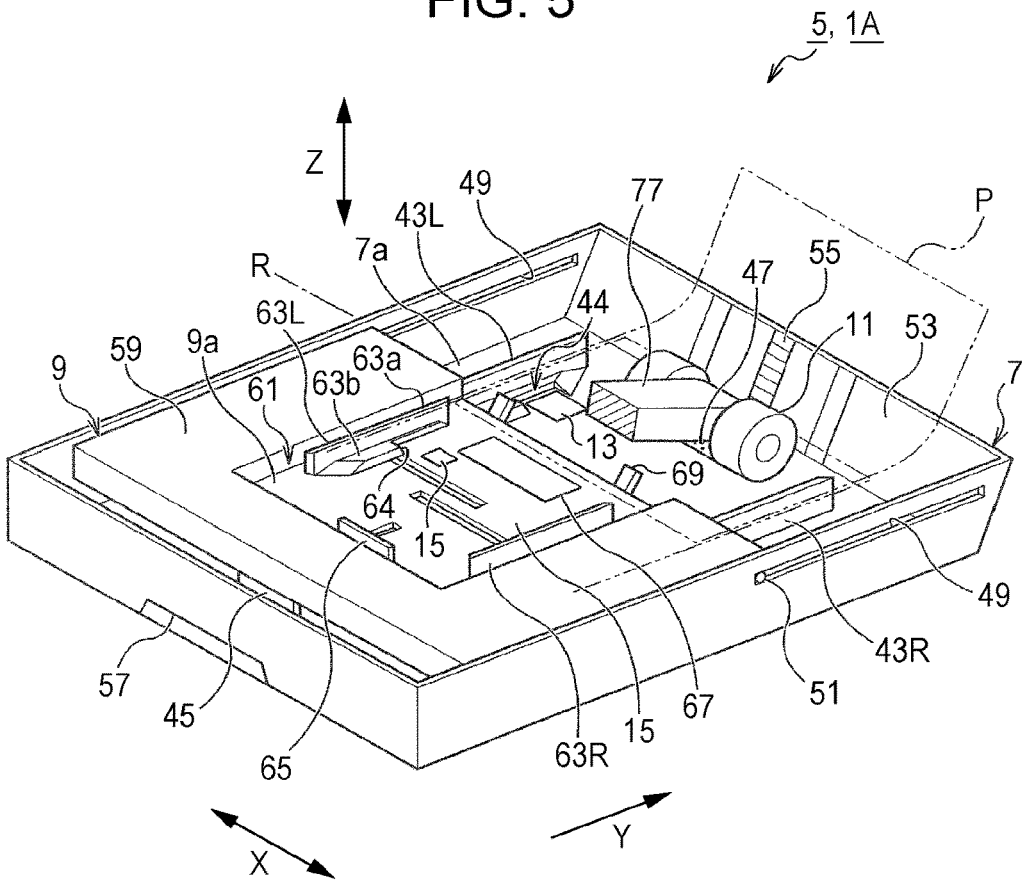
FIG. 5 is a perspective view illustrating the multi-level tray of the recording apparatus according to the first embodiment of the invention in an assembled state when feeding the recording medium from the first tray.

In the present embodiment, as illustrated in FIG. 4, the first reflecting portion 13 is provided in a position proximal to the left end of the front side of the friction sheet 47 which is provided in the center of the bottom surface of the first tray 7 close to the guide inclined surface 53. As illustrated in FIG. 5, the position of the first reflecting portion 13 is set to a position at which the light path from the optical sensor 17 is not blocked by a rocking member 77 which supports the feed roller 11 to be freely rotatable on the free end.

Although not depicted in the drawings, when there is a concern that the light path from the optical sensor 17 will be blocked by the rocking member 77 due to the layout and the like, it is possible to ensure that the light path is secured by forming a cut-out portion, a hole portion, or a thin diameter portion in a portion of the rocking member 77, or by folding or bending the rocking member 77.

The second reflecting portion 15 is provided in a position which overlaps the first reflecting portion 13 in the direction Z which orthogonally intersects the mounting surface 9*a* of the second tray 9 in a state in which the second tray 9 is positioned in the feeding position F illustrated in FIG. 6.

Figure 9A:
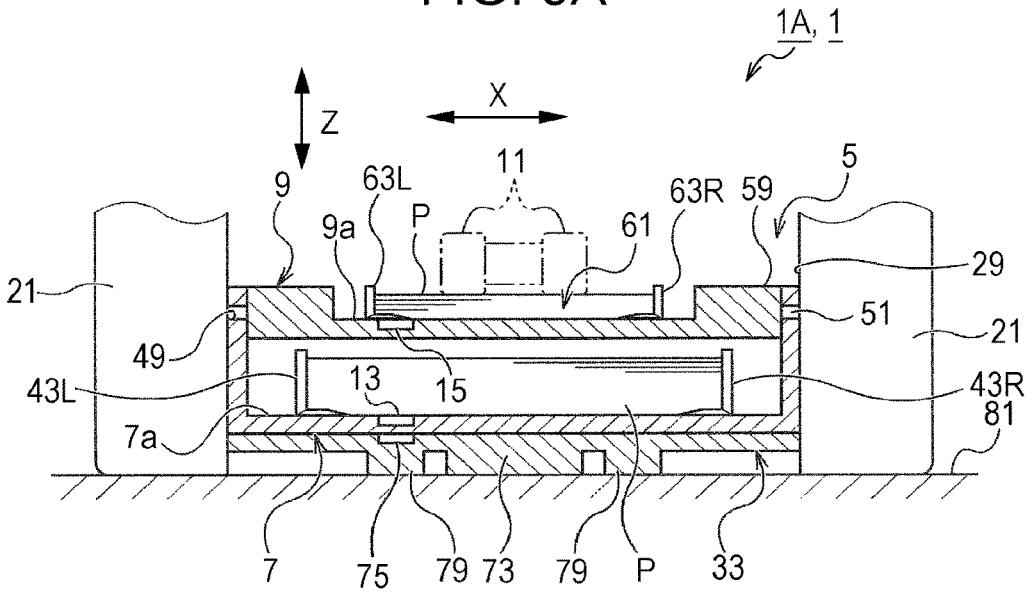
FIGS. 9A and 9B illustrate the positional relationship between the multi-level tray and a first reflecting portion, a second reflecting portion, and a tray detection reflecting portion of the recording apparatus according to the first embodiment of the invention, where
Figure 9B:
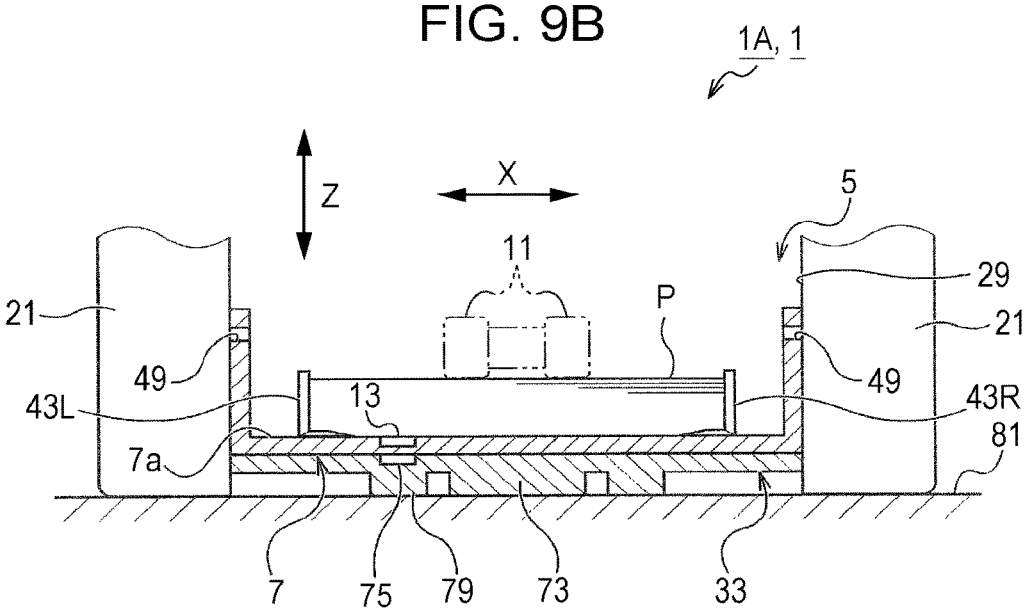

As illustrated in FIGS. 9A and 9B, a single or a plurality of protruding portions 79 is provided in the support portion 33. The protruding portion 79 protrudes downward and is thickened in a position which corresponds to the part in which the tray detection reflecting portion 75 is formed.

The rigidity of the support portion 33 is increased by the protruding portion 79, the deformation of the tray support portions 71 and 73 as time elapses is reduced, and the detection precision of the tray detection reflecting portion 75 is configured to be maintained. Note that, for example, the support portion 33 is formed of a resin. The support portion 33 is positioned higher than an installation surface 81 of the recording apparatus 1, and is provided with the protruding portion 79 which makes contact with the installation surface 81 on the installation surface 81 side. In other words, the height of the protruding portion 79 is set such that the protruding portion 79 makes contact with the installation surface 81 of the recording apparatus main body 21. Note that, the protruding portion 79 may be configured not to make contact with the installation surface 81.

The optical sensor 17 is provided in a position above the first reflecting portion 13 in the direction Z which orthogonally intersects the mounting surface 7*a* of the first tray 7, and the tray detection reflecting portion 75 is provided in a region which overlaps the first reflecting portion 13 in the direction Z which orthogonally intersects the mounting surface 7*a* of the first tray 7.

Note that, a range indicated by the orthogonally intersecting direction Z and the overlapping region means a range of an angular range with a fixed width at which at least a portion of the first reflecting portion 13, the second reflecting portion 15, and the tray detection reflecting portion 75 enter the light path of the light which is radiated from the optical sensor 17 and it is possible to identify the first reflecting portion 13, the second reflecting portion 15, and the tray detection reflecting portion 75, permitting an amount of misalignment.

In the present embodiment, as described earlier, the first tray 7 is provided with two first moveable edge guides 43L and 43R which restrict the width of the paper P and are capable of moving in the width direction X, and the first reflecting portion 13 is disposed in a position in which at least a portion thereof enters the moveable region of the first moveable edge guide 43L of the left side, which is a position at which the light path from the optical sensor 17 is not blocked due to the presence of the cut-out portion 44. This refers to a position at which, when the reception portion 43*b* is present across the whole width of the first moveable edge guide 43L in the feed direction, the first reflecting portion 13 enters a portion of the moveable region of the reception portion 43*b* of the first moveable edge guide 43L of the left side. In other words, at least a portion of the first reflecting portion 13 is present within the width of the feed direction of the moveable region of the first moveable edge guide 43L, and is in a position which is present in the region which extends in the feed direction from the reception portion 43*b* of the first moveable edge guide 43L of the left side when the first moveable edge guides 43L and 43R move to the minimum width.

In the present embodiment, as described earlier, the second tray 9 is provided with two second moveable edge guides 63L and 63R which restrict the width of the paper P and are capable of moving in the width direction X, and the second reflecting portion 15 is disposed in a position in which at least a portion thereof enters the moveable region of the second moveable edge guide 63L of the left end side, which is a position at which the light path from the optical sensor 17 is not blocked due to the presence of the cut-out portion 64. This refers to a position at which, when the reception portion 63*b* is present across the whole width of the second moveable edge guide 63L in the feed direction, the second reflecting portion 15 enters a portion of the moveable region of the reception portion 63*b* of the second moveable edge guide 63L of the left side. In other words, at least a portion of the second reflecting portion 15 is present within the width of the feed direction of the moveable region of the second moveable edge guide 63L, and is in a position which is present in the region which extends in the feed direction from the reception portion 63*b* of the second moveable edge guide 63L of the left side when the second moveable edge guides 63L and 63R move to the minimum width.

As illustrated in FIGS. 2 and 3, in the present embodiment, a second tray detection sensor 83 which detects the feeding position F of the second tray 9 is provided in the bottom region of the inner portion of the recording apparatus main body 21. It is possible to use various sensors such as a contact system or a contactless system sensor as the second tray detection sensor 83.

Incidentally, by providing the second tray detection sensor 83, it is possible to easily ascertain whether the second tray 9 is positioned in the feeding position F or is positioned in the retraction position R, and, by combining the second tray detection sensor 83 with the optical sensor 17 described earlier, it is possible to perform the control illustrated in FIG. 11 (described later).

Next, description will be given of the operations of the recording apparatus 1A according to the present embodiment which is configured in this manner, divided into (A) a first feeding in which the paper P which is stored in the first tray 7 is fed, (B) a second feeding in which the paper P which is stored in the second tray 9 is fed, (C) a reverse surface recording in which the recording of the reverse surface of the paper P in which recording to the obverse surface has been executed is executed, and (D) a paper setting in which the paper P is set in the first tray 7 or the second tray 9.

A. First Feeding (Refer to FIGS. 2 and 5)

As illustrated in FIGS. 2 and 5, when feeding the paper P which is stored in the first tray 7, the second tray 9 is pulled forward and positioned in the retraction position R, the feed roller 11 is caused to abut the paper P of the top position which is stored in the first tray 7, and the paper P is fed by rotationally driving the feed roller 11 in the feed direction Y.

The setting of the paper P, the width adjustment by the first moveable edge guides 43L and 43R, and the like are performed before the feeding of the paper P. As described later, the determination of whether or not the multi-level tray 5 is mounted using the optical sensor 17 and the tray detection reflecting portion 75, the determination of the position of the second tray 9 using the second tray detection sensor 83, and the determination of whether the paper P is present or absent using the optical sensor 17 and the first reflecting portion 13 or the optical sensor 17 and the paper P which is stored in the first tray 7 are executed.

The paper P which is fed from the first tray 7 in this manner is inverted by the intermediate roller 37, is subsequently transported by the transport roller 39 to the recording execution region in which the recording head 3 is present, and the desired recording is executed.

B. Second Feeding (Refer to FIGS. 3 and 6)

As illustrated in FIGS. 3 and 6, when feeding the paper P which is stored in the second tray 9, the second tray 9 is pushed into the inner portion side and positioned in the feeding position F, the feed roller 11 is caused to abut the paper P of the top position which is stored in the second tray 9, and the paper P is fed by rotationally driving the feed roller 11 in the feed direction Y.

The setting of the paper P, the width adjustment by the second moveable edge guides 63L and 63R, and the like are performed before the feeding of the paper P. As described later, the determination of whether or not the multi-level tray 5 is mounted using the optical sensor 17 and the tray detection reflecting portion 75, the determination of the position of the second tray 9 using the second tray detection sensor 83, and the determination of whether the paper P is present or absent using the optical sensor 17 and the second reflecting portion 15 or the optical sensor 17 and the paper P which is stored in the second tray 9 are executed.

In the same manner as in (A) the first feeding described above, the paper P which is fed from the second tray 9 in this manner is inverted by the intermediate roller 37, is subsequently transported by the transport roller 39 to the recording execution region in which the recording head 3 is present, and the desired recording is executed.

C. Reverse Surface Recording (Refer to FIGS. 2 and 3)

When further executing the recording on the reverse surface of the paper P which is output to the downstream of the recording execution region by the output roller 41 after the recording is executed on the obverse surface of the paper P, the paper P is caused to reverse by reversing the rotation directions of the output roller 41 and the transport roller 39, and the paper P is caused to pass through the recording execution region and again reaches the upstream position of the intermediate roller 37 via the inverted recording return path 68 (FIG. 2).

Hereinafter, in the same manner as when executing the recording on the obverse surface, the obverse surface and the reverse surface of the paper P are inverted by the intermediate roller 37, the paper P receives transport force from the transport roller 39 and is transported to the recording execution region in a state in which the reverse surface is facing upward, and the desired recording is executed on the reverse surface of the paper P by ink being ejected from the recording head 3.

D. Paper Setting (Refer to FIGS. 5 and 7)

As illustrated in FIG. 7, when setting the paper P in the first tray 7, the second tray 9 is set to a wide-open state by being pivoted upward using the slide protrusions 51 as a fulcrum in a state in which the second tray 9 is moved to the feeding position F, and the top surface of the first tray 7 is greatly exposed to set the first tray 7 to an open state.

Next, the paper P on which to execute the recording is stored within the first tray 7, the width of the paper P is restricted using the left and right first moveable edge guides 43L and 43R, and the position of the paper P in the feed direction Y is adjusted using the front end edge guide 65. The first reflecting portion 13 which is formed on the mounting surface 7*a* of the first tray 7 assumes a state of being covered by the paper P in the state in which the paper P is set in this manner.

Meanwhile, as illustrated in FIG. 5, when the paper P is set in the second tray 9, the second tray 9 is set to a state of being moved to the retraction position R. The paper P from the top surface of the concave portion 61 of the open second tray 9 is stored in the second tray 9, the width of the paper P is restricted using the left and right second moveable edge guides 63L and 63R, and the position of the paper P in the feed direction Y is adjusted using the front end edge guide 65.

Note that, the second reflecting portion 15 which is formed on the mounting surface 9*a* of the second tray 9 assumes a state of being covered by the paper P in the state in which the paper P is set in this manner.

3. Example of State Distinction Method Based on Thresholds (Refer to FIG. 10)

As described earlier, in the present embodiment, by causing the reflectance of each of the first reflecting portion 13, the second reflecting portion 15, and the tray detection reflecting portion 75 to differ from each other, and further providing a difference between the aforementioned members and the reflectance of the paper P, the setting of the thresholds which are used when discerning which reflecting portion the reflected light which is received by the optical sensor 17 is from is rendered easy, and the discernment of each state is made possible.

Figure 10:
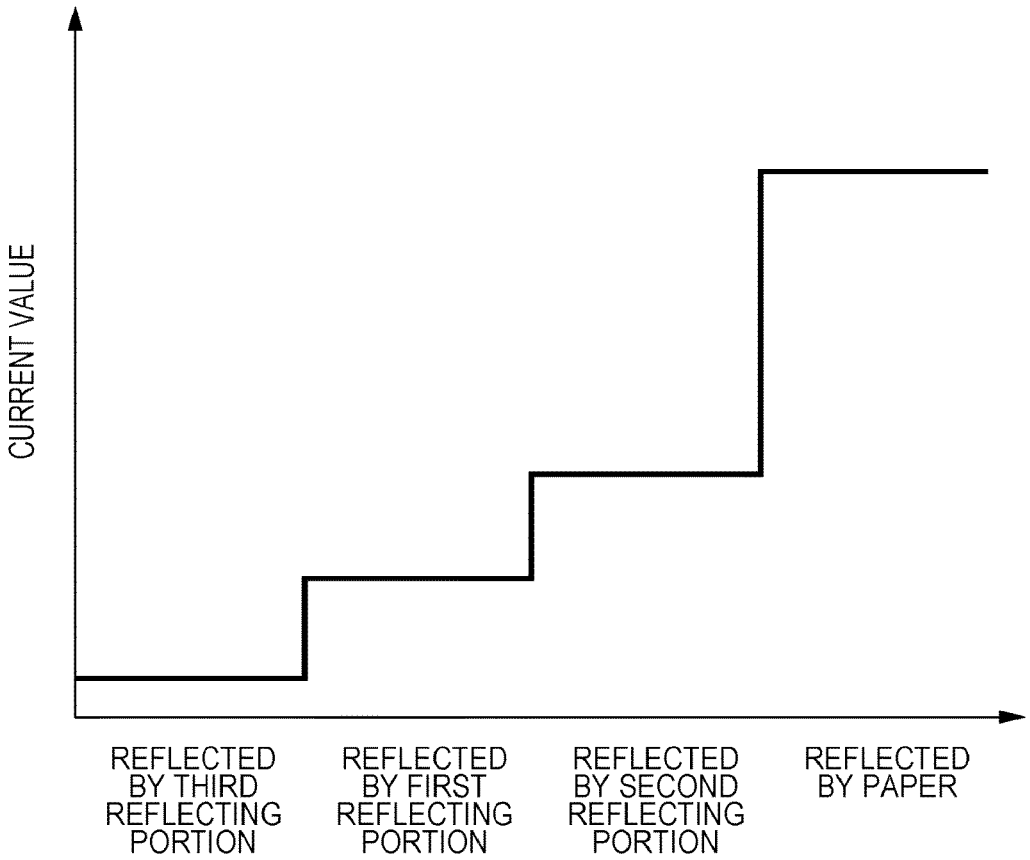
FIG. 10 is a graph illustrating examples of thresholds for state distinction which is performed by an optical sensor of the recording apparatus according to the first embodiment of the invention.
Figure 11:
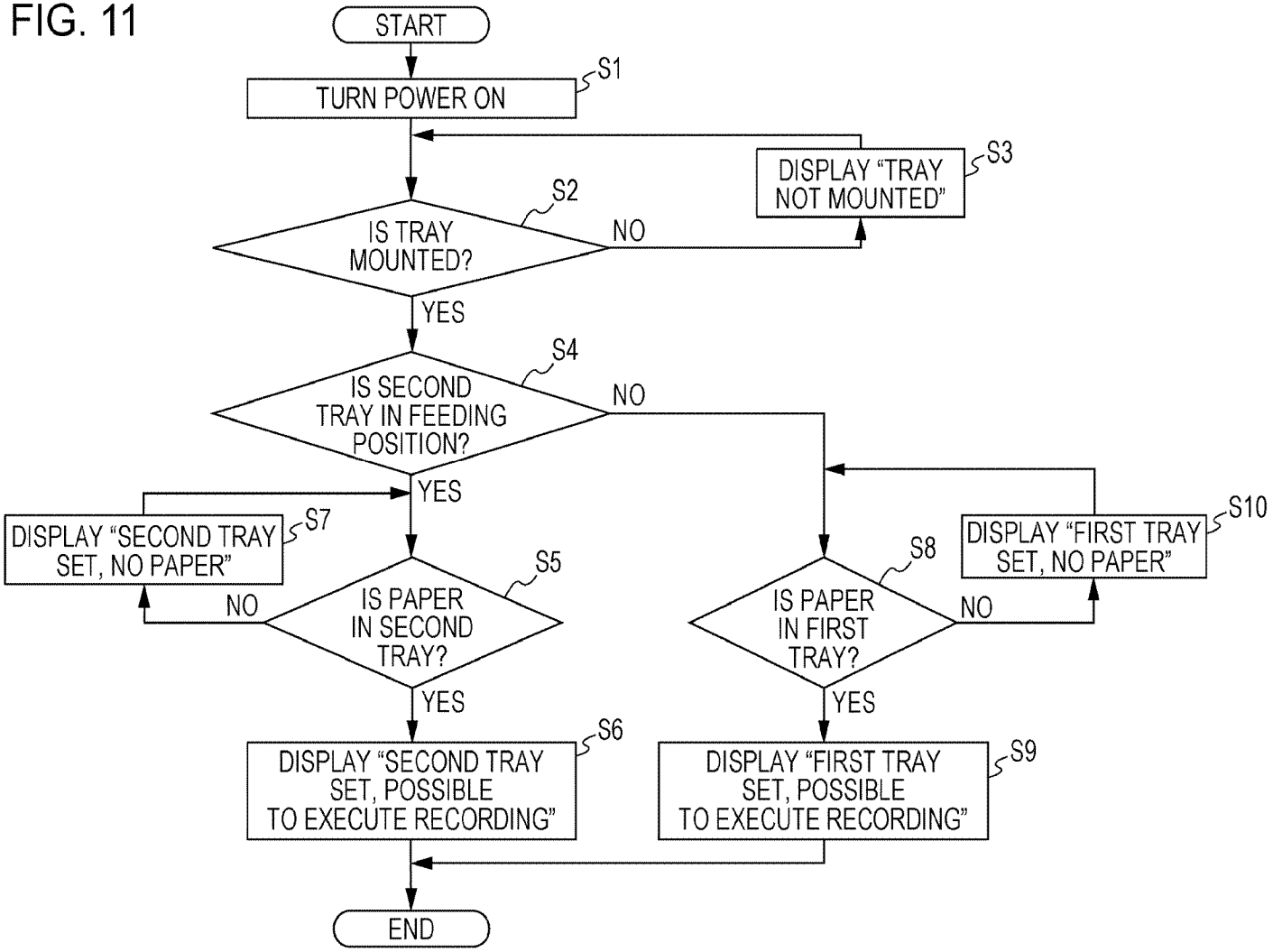
FIG. 11 is a flowchart illustrating an example of the control in the recording apparatus according to the first embodiment of the invention based on the detection of whether or not a tray is mounted, the detection of the position of the second tray, and the detection of whether or not the recording medium is present in each tray.

The threshold for discerning each of the states is set as illustrated in FIG. 10, for example. In other words, the current values of the light which is reflected by each of the tray detection reflecting portion 75, first reflecting portion 13, and the second reflecting portion 15 are set to increase gradually in this order. The current value of the light which is reflected by the tray detection reflecting portion 75 which is used when inserting or removing the multi-level tray 5 is the lowest, the current value of the light which is reflected by the first reflecting portion 13 which detects whether the paper P which is stored in the first tray 7 is present or absent is higher, and the current value of the light which is reflected by the second reflecting portion 15 which detects whether the paper P which is stored in the second tray 9 is present or absent is higher still.

Since there is variation in the reflectance depending on the type of the paper P, the reflectance of each of the first reflecting portion 13, the second reflecting portion 15, and the tray detection reflecting portion 75 is set to have a large difference from the reflectance of the paper P such that even if there is variation in the reflectance depending on differences in the type of the paper P, the influence of the variation is not easily received. In other words, the reflectance of each of the first reflecting portion 13, the second reflecting portion 15, and the tray detection reflecting portion 75 is set to a threshold which is clearly lower than the reflectance of the paper P, as illustrated in FIG. 10.

It is desirable to set the reflectance of each of the reflecting portions 13, 15, and 75 in consideration of the distance between each of the reflecting portions 13, 15, and 75, and the optical sensor 17 such that it is easy for the optical sensor 17 to discern whether the reflected light if from the first reflecting portion 13, the second reflecting portion 15, or the tray detection reflecting portion 75. In other words, for example, it is desirable to set each reflectance in an aspect in which it is possible to clearly discern the differences in strength of the reflected light which is received by the optical sensor 17 due to difference between each of the reflecting portions 13, 15, and 75. There is a case in which it is possible to discern each of the reflecting portions 13, 15, and 75 from each other due to the difference in the distance, even if the reflectance itself is the same.

In other words, if the difference between the strength of the light which is reflected from the first reflecting portion 13, the second reflecting portion 15, and the tray detection reflecting portion 75, and the strength of the light which is reflected from the paper P is set to be large, it becomes easy to perform the determination of each state without receiving the influence of the difference in the type of the paper P.

4. Example of Control of Recording Apparatus (Refer to FIG. 11)

Next, description will be given of an example of the control of the recording apparatus 1A based on the detection of whether or not the multi-level tray 5 is mounted, the detection of the position of the second tray 9, and the detection of whether or not the recording medium P of each of the trays 7 and 9 is present or absent, which is executed by using the recording apparatus 1A of the configuration described above, according to the flowchart illustrated in FIG. 11.

First, when the power of the recording apparatus 1A is turned on in step S1, whether or not the multi-level tray 5 is mounted is determined in step S2 using the reflected light of the light which is radiated from the optical sensor 17 toward the tray detection reflecting portion 75. When it is determined that the multi-level tray 5 is not mounted in step S2, the process transitions to step S3, and the fact that the multi-level tray 5 is not mounted is displayed on the display unit 25 of the operation panel 23 of the recording apparatus 1A.

After the multi-level tray 5 is mounted, it is determined again whether or not the multi-level tray 5 is mounted in step S2. When the mounting of the multi-level tray 5 is confirmed in step S2, the process transitions to step S4, and the position of the second tray 9 is determined by the second tray detection sensor 83.

When it is determined that the second tray 9 is positioned in the feeding position F in step S4, the process transitions to step S5, and it is determined whether the paper P is present or absent in the second tray 9 using the reflected light of the light which is radiated from the optical sensor 17 toward the second reflecting portion 15.

When it is determined that the paper P is present in the second tray 9 in step S5, the process transitions to step S6, and the fact that the second tray 9 is correctly set and that it is possible to execute the recording is displayed on the display unit 25 of the operation panel 23 of the recording apparatus 1A.

Meanwhile, when it is determined that the paper P is absent from the second tray 9 in step S5, the process transitions to step S7, and the fact that the paper P is absent from the second tray 9 and to set the paper P and set the second tray 9 again is displayed on the display unit 25 of the operation panel 23 of the recording apparatus 1A. After the paper P is set and the second tray 9 is set again, it is determined again whether the paper P is present or absent in the second tray 9 in step S5.

When it is determined that the second tray 9 is not positioned in the feeding position F in step S4, it is determined that the second tray 9 is positioned in the retraction position R, and it is determined whether the paper P is present or absent in the first tray 7 in step S8 using the reflected light of the light which is radiated from the optical sensor 17 toward the first reflecting portion 13.

When it is determined that the paper P is present in the first tray 7 in step S8, the process transitions to step S9, and the fact that the first tray 7 is correctly set and that it is possible to execute the recording is displayed on the display unit 25 of the operation panel 23 of the recording apparatus 1A.

Meanwhile, when it is determined that the paper P is absent from the first tray 7 in step S8, the process transitions to step S10, and the fact that the paper P is absent from the first tray 7 and to set the paper P and to set the first tray 7 again is displayed on the display unit 25 of the operation panel 23 of the recording apparatus 1A.

After the paper P is set and the first tray 7 is set again, it is determined again whether the paper P is present or absent in the first tray 7 in step S8.

Subsequently, when the recording is executed under the same conditions, steps S1 to S4 are omitted, the processes of steps S5 to S7 or steps S8 to S10 are executed, and when the recording is not executed under the same conditions, the process is ended.

According to the recording apparatus 1A according to the first embodiment which is configured in this manner, it is possible to obtain a reduction in the size of the recording apparatus 1A using a compact configuration which is provided with the multi-level tray 5 from which it is possible to feed the paper P using the shared feed roller 11.

It becomes possible to make efficient use of parts and to reduce the number of parts by performing the determination of whether the paper P is present or absent in the first tray 7 and the second tray 9, and the determination of whether the trays 7 and 9 are mounted or not using the shared optical sensor 17.

It becomes possible to reduce the burden placed on the user by the operation when executing the recording due to each state being discerned based on the detection information which is obtained by the optical sensor 17 and the second tray detection sensor 83, and the user being notified of the discerned state.

By forming the cut-out portion 44 in one of the first moveable edge guides 43L and forming the cut-out portion 64 in one of the second moveable edge guides 63L, it becomes possible to support the paper P with a narrower width, to dispose compact members, and to contribute to the reduction in the size of the apparatus.

Second Embodiment (Refer to FIGS. 12 to 15)

A recording apparatus 1B according to the second embodiment has essentially the same configuration as the recording apparatus 1A according to the first embodiment described earlier, and a portion of the configuration has differences. Therefore, here, description of the configuration which is the same as in the first embodiment will be omitted, and description will be limited to the configuration which differs from the first embodiment and the operations thereof.

In other words, in the second embodiment, an output stacker 87 which pivots in relation to the side surface portion using a shaft portion 85 as the fulcrum is provided as an example of the first tray 7. In the same manner as the slide system output tray 35 which is provided in the first embodiment, the output stacker 87 is a member for receiving the paper P which is output via the recording execution region.

The output stacker 87 is a member with the shape of a cover with a gate shaped cross-section, and includes a front plate portion 88, a top plate portion 89, and left and right side plate portions 91L and 91R. The top plate portion 89 is provided with two ribs 93 and 93, and a cut-out portion 95. The ribs 93 and 93 are for reducing the friction with the paper P and extend along an output direction E, and the cut-out portion 95 prevents interference between the top plate portion 89 and an operation protruding portion 97 which is used when moving the second tray 9 and is for enabling the operation of the operation protruding portion 97.

The space beneath the top plate portion 89 of the output stacker 87 is a storage space of the second tray 9 when the second tray 9 is moved to the retraction position R, and the height of the top plate portion 89 is set to a height at which the second tray 9 does not collide therewith when the second tray 9 is moved to the retraction position R.

In the second embodiment, unlike in the first embodiment, the cut-out portion 64 is not formed in the reception portion 63*b* of the second moveable edge guide 63L of the left side. The disposition of the second reflecting portion 15 differs from that in the first embodiment, and in the present embodiment, the second reflecting portion 15 is disposed in a position on the mounting surface 9*a* of the paper P of the second tray 9 which does not interfere with the second moveable edge guides 63L and 63R, for example, a position near the right end of the front side of the friction sheet 67. Note that, the term "a position which does not interfere" means that the second reflecting portion 15 is positioned outside of the moveable region of the second moveable edge guides 63L and 63R. In other words, this means that the second reflecting portion 15 is present within the width of the feed direction of the moveable region of the second moveable edge guides 63L and 63R, and is in a position which does not overlap the second moveable edge guides 63L and 63R when moving the second moveable edge guides 63L and 63R the minimum width.

In addition, in the present embodiment, two of the optical sensors 17 are used, a first optical sensor 17A which detects the first reflecting portion 13, and a second optical sensor 17B which detects the second reflecting portion 15.

In the second embodiment, the pivoting of the second tray 9 is configured to be performed using a hinge 99 as the fulcrum, and the second tray 9 and the first tray 7 are connected using a configuration capable of only sliding in a direction along the feed direction Y due to the engagement between the slide groove 49 and the slide protrusion 51. For example, the hinge 99 is provided on the rear end portion of the tray main body 59.

Figure 12:
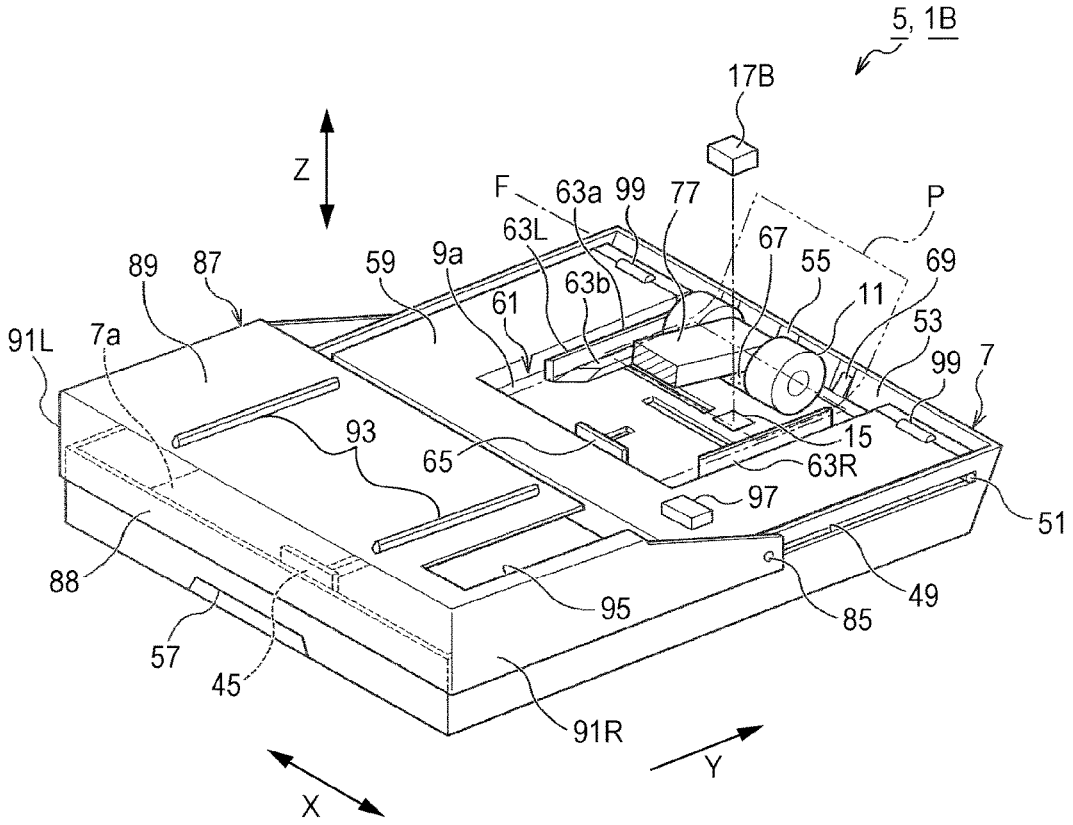
FIG. 12 is a perspective view illustrating an assembly state of a multi-level tray of the recording apparatus according to the second embodiment when feeding the recording medium which is stored in a second tray.
Figure 14:
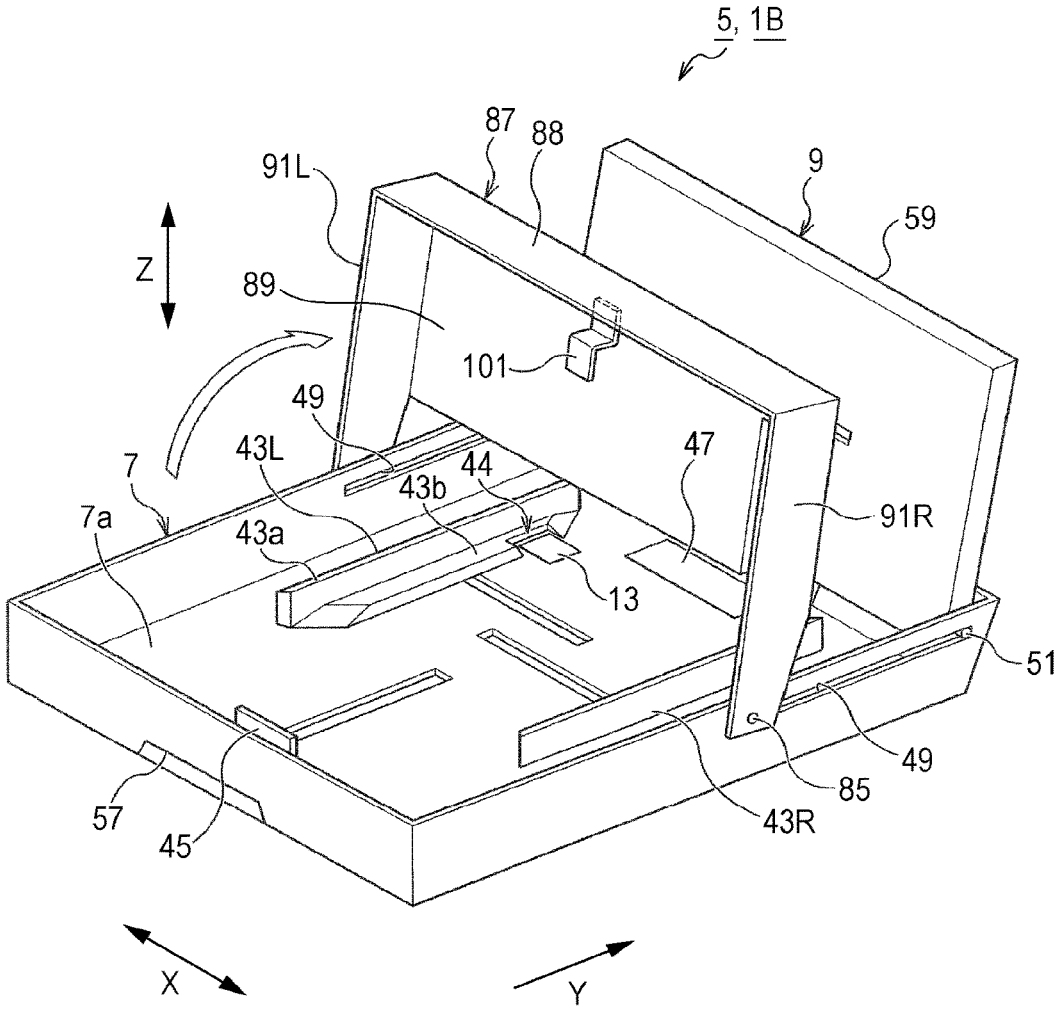
FIG. 14 is a perspective view illustrating an assembly state of the multi-level tray of the recording apparatus according to the second embodiment when an output stacker and the second tray are pivoted from the state in FIG. 12 to open the first tray.

When setting the paper P in the first tray 7 using the recording apparatus 1B of this configuration, as illustrated in FIG. 14, the output stacker 87 is pivoted upward using the shaft portion 85 as a fulcrum in the state of FIG. 12 in which the second tray 9 is positioned in the feeding position F, the top surface of the first tray 7 is greatly exposed by pivoting the second tray 9 upward in the same manner using the hinge 99 as a fulcrum to set the first tray 7 to the exposed state, and the paper P is set therein.

Figure 13:
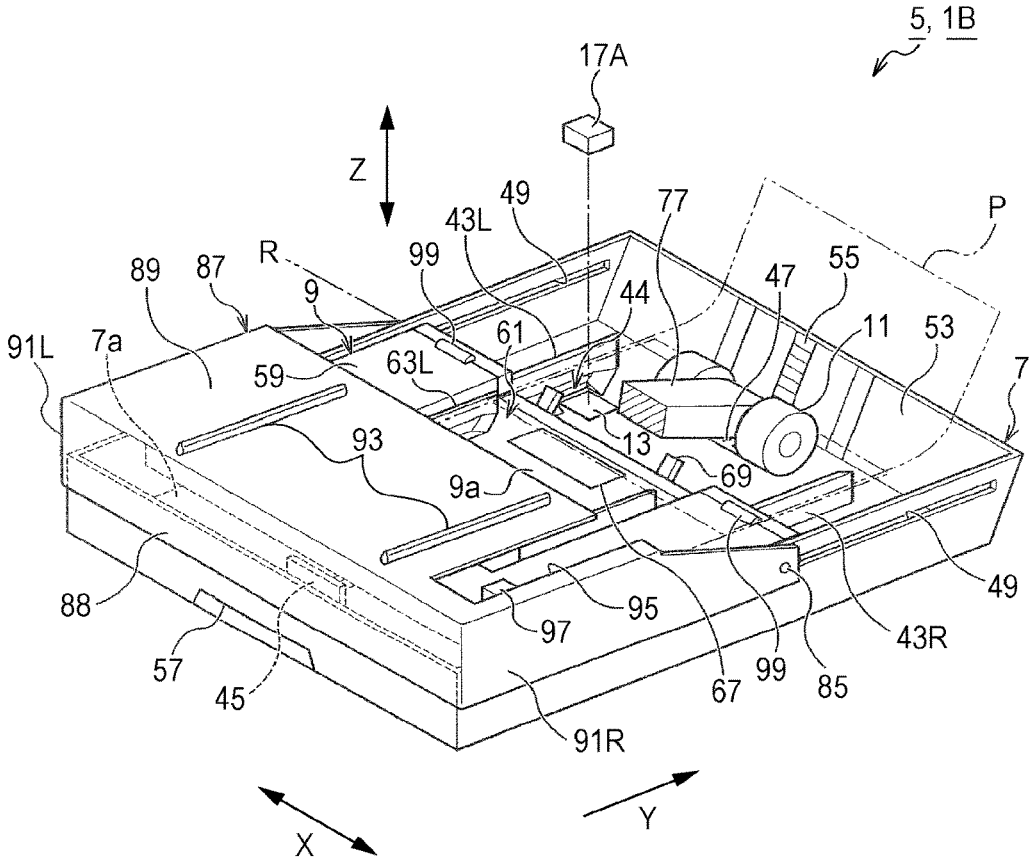
FIG. 13 is a perspective view illustrating an assembly state of the multi-level tray of the recording apparatus according to the second embodiment when feeding the recording medium which is stored in a first tray.
Figure 15:
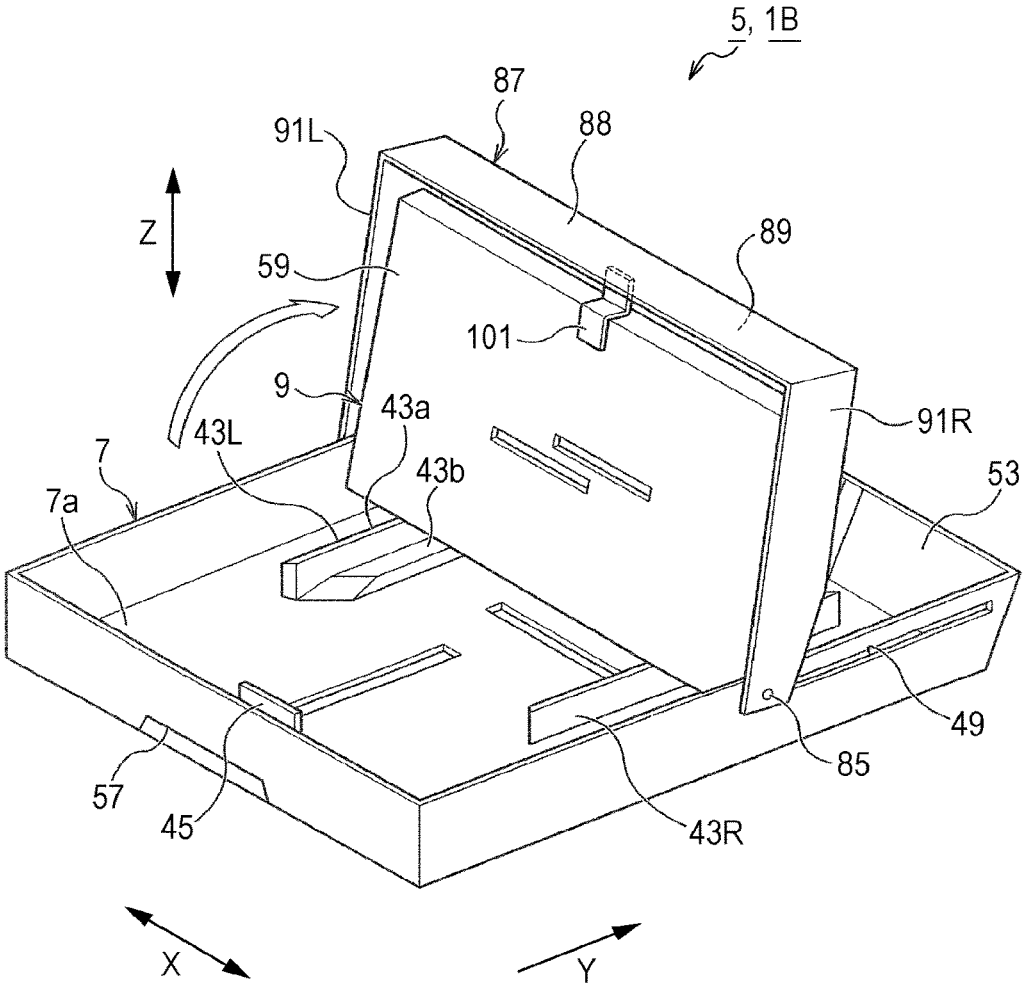
FIG. 15 is a perspective view illustrating an assembly state of the multi-level tray of the recording apparatus according to the second embodiment when the output stacker and the second tray are pivoted from the state in FIG. 13 to open the first tray.

By pivoting the output stacker 87 upward using the shaft portion 85 as a fulcrum as illustrated in FIG. 15 in the state of FIG. 13 in which the second tray 9 is positioned in the retraction position R, a second tray locking piece 101 which, for example, is provided in the center portion of the front plate portion 88 of the output stacker 87 acts on the bottom surface of the second tray 9 near the front surface of the tray main body 59, and the second tray 9 also pivots at the same time using the hinge 99 as a fulcrum.

Therefore, in this case, it becomes possible to set the top surface of the first tray 7 to the open state using only one operation of pivoting the output stacker 87, and to set the paper P.

According to the recording apparatus 1B according to the second embodiment which is configured in this manner, since two of the optical sensors 17 are necessary, a corresponding number of parts and installation space are necessary; however, it is possible to enjoy the same operations and effects as the recording apparatus 1A according to the first embodiment described earlier.

Figure 16:
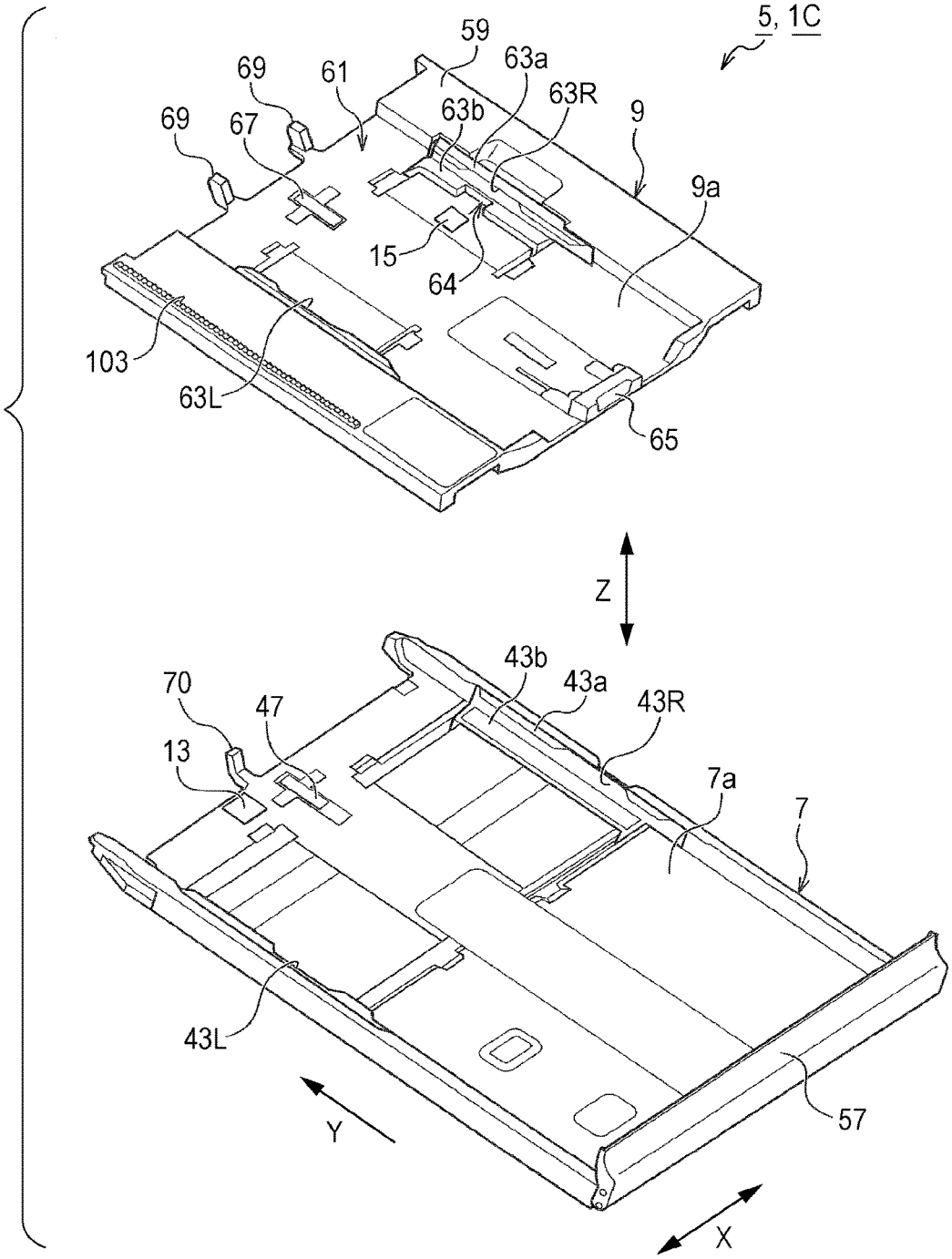
FIG. 16 is a perspective view illustrating a multi-level tray of a recording apparatus according to a third embodiment of the invention in a dismantled state.
Figure 17:
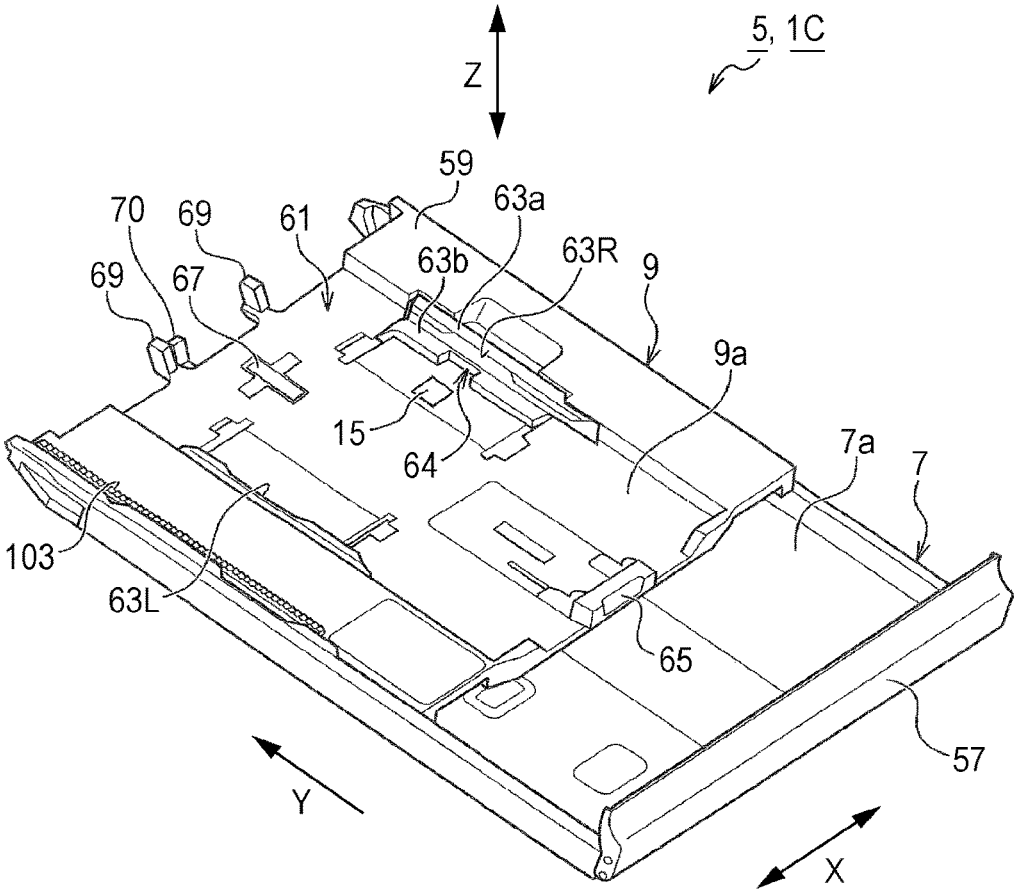
FIG. 17 is a perspective view illustrating the multi-level tray of the recording apparatus according to the third embodiment of the invention in an assembled state.
Figure 18:
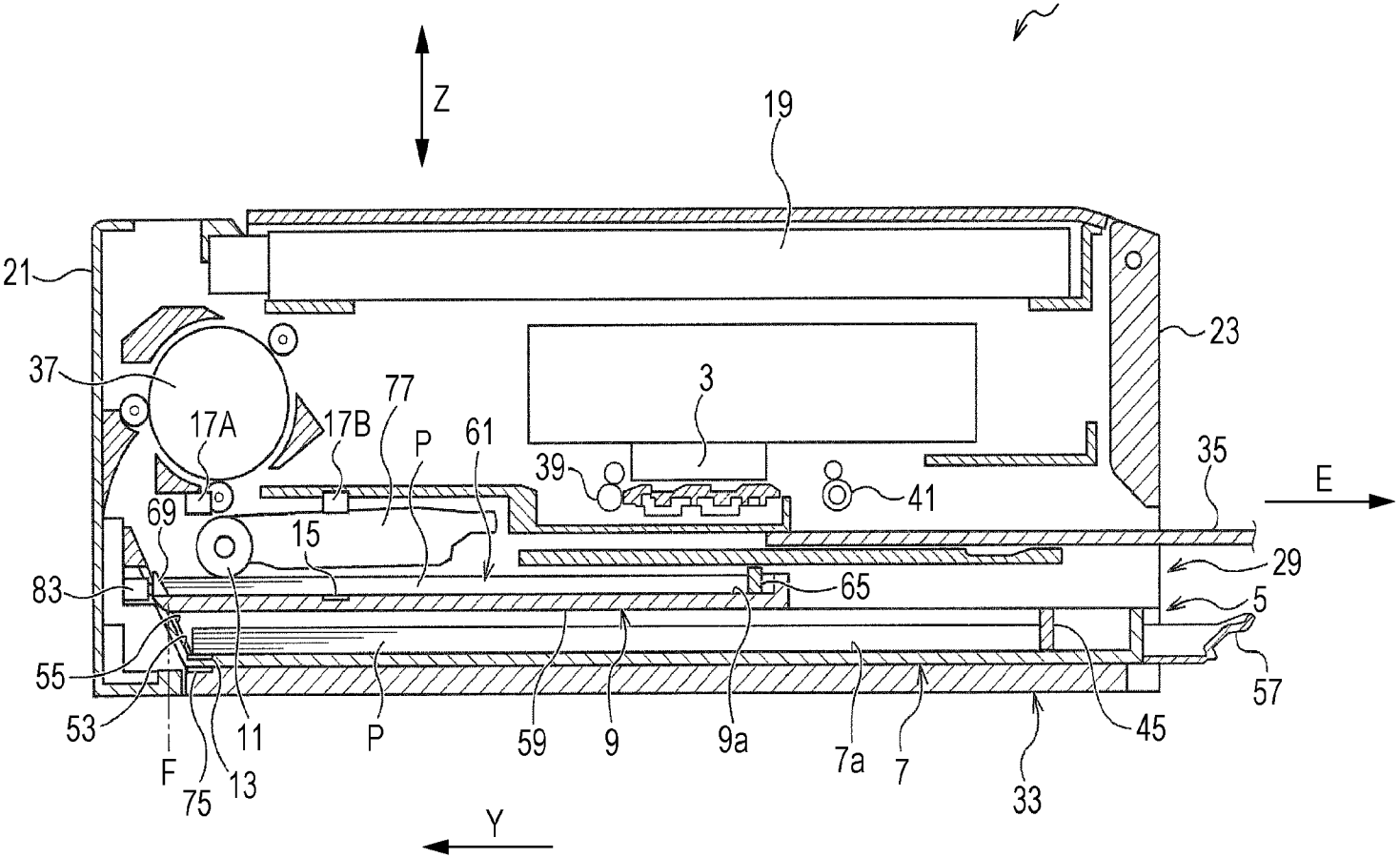
FIG. 18 is a side cross-sectional diagram illustrating the recording apparatus according to the third embodiment of the invention when feeding the recording medium from the second tray.

Third Embodiment (Refer to FIGS. 16 to 18)

A recording apparatus 1C according to the third embodiment has essentially the same configuration as the recording apparatus 1A according to the first embodiment described earlier, and a portion of the configuration has differences. Therefore, here, description of the configuration which is the same as in the first embodiment will be omitted, and description will be limited to the configuration which differs from the first embodiment.

In other words, in the third embodiment, the first tray 7 and the second tray 9 engage with each other using the slide groove 49 and the slide protrusion 51 as in the first embodiment, and instead of a structure in which the two may not be separated, a separable structure is adopted in which the second tray 9 is simply mounted on the first tray 7.

Specifically, the width dimension of the second tray 9 is set to a dimension which fits between the inner wall surfaces of the left and right side plate portions of the first tray 7, and the first tray 7 itself adopts a structure which restricts the backlash of the second tray 9 in the width direction X and guides the movement of the second tray 9 along the feed direction Y.

A rack 103 is provided on the top surface close to the end of one side of the tray main body 59 of the second tray 9, and is configured to be capable of automating the movement of the second tray 9 between the feeding position F and the retraction position R by meshing with a pinion gear (not shown) which is rotationally driven by a motor (not shown).

In addition, the second tray 9 is in a state of being held between the pinion gear (not shown) and the first tray 7, and the lifting of the second tray 9 is prevented by this configuration.

The mounting surface 7*a* of the first tray 7 and the downstream end of the mounting surface 9*a* of the second tray 9 are open. A stopper 70 is provided on the downstream end of the mounting surface 7*a* of the first tray 7, a stopper 69 is provided on the downstream end of the mounting surface 9*a* of the second tray 9, and the stoppers 70 and 69 prevent the stacked paper P from collapsing.

The separation inclined surface 55 which corresponds to the one in the first and second embodiments and separates the paper P of the top position of the first tray 7 from the paper P of the bottom position is provided in the recording apparatus main body 21.

In the present embodiment, unlike in the first embodiment, the cut-out portion 44 is not formed in the reception portion 43*b* of the first moveable edge guides 43L and 43R. The disposition of the first reflecting portion 13 differs from that in the first embodiment, and in the present embodiment, the first reflecting portion 13 is changed to a position on the mounting surface 7*a* of the paper P of the first tray 7 which does not interfere with the first moveable edge guides 43L and 43R, for example, a position which is moved to side of the friction sheet 47, that is, to the inside portion side which is in the proximity of the stopper 70.

In other words, the stopper 70, which has the same function as the two stoppers 69 and 69 which are provided on the second tray 9, is provided on the first tray 7 in one location on the end portion of the inside portion side of the first tray 7. Accordingly, since the first reflecting portion 13 is present outside of the width in the feed direction of the moveable region of the first moveable edge guides 43L and 43R, the first reflecting portion 13 will not overlap the first moveable edge guides 43L and 43R even if the first moveable edge guides 43L and 43R are moved the minimum width.

In addition, as illustrated in FIG. 18, in the present embodiment, in the same manner as in the second embodiment, two of the optical sensors 17 are used, the first optical sensor 17A which detects the first reflecting portion 13, and the second optical sensor 17B which detects the second reflecting portion 15.

In the third embodiment, for the first tray 7, the first tray 7 which is flatter than the one in the first embodiment is adopted, and a structure is adopted in which the second tray 9 is directly mounted on the first tray 7. As illustrated in FIG. 18, the position of the second tray detection sensor 83 is moved to a position of the inside portion side of the inside portion of the recording apparatus main body 21, unlike in the first embodiment. The second tray detection sensor 83 is configured to detect the stopper 69.

According to the recording apparatus 1C according to the third embodiment which is configured in this manner, in the same manner as in the second embodiment, since two of the optical sensors 17 are used, the number of parts and the like increases; however, it is possible to enjoy the same operations and effects as the recording apparatus 1A according to the first embodiment described earlier.

Note that, in the third embodiment, it is possible to dispose the first reflecting portion 13 in an inside position on the outside of the moveable region of the first moveable edge guides 43L and 43R, which is a position which overlaps the second reflecting portion 15.

When the first reflecting portion 13 is disposed in such a position, since it is possible to detect the first reflecting portion 13 and the second reflecting portion 15 using the shared optical sensor 17, it becomes possible to obtain a reduction in the number of parts.

Specifically, it is possible to use the shared optical sensor 17 when the width dimension of the paper P which is used when the first moveable edge guides 43L and 43R of the first tray 7 are moved furthest to the inside is greater than the width dimension of the paper P which is used when the second moveable edge guides 63L and 63R of the second tray 9 are moved furthest to the inside, and when the disposition conditions of the first reflecting portion 13 and the second reflecting portion 15 are satisfied.

Note that, the support portion 33 of the present embodiment is formed of a single member. In other words, in the first embodiment, the support portion 33 is configured to be divided into two portions, the front-side tray support portion 71 and the rear-side tray support portion 73, and a portion of the bottom surface of the first tray 7 is exposed; however, in the present embodiment, since the support portion 33 is formed of a single member, the bottom surface of the first tray 7 is not exposed.

Other Embodiments

The recording apparatus 1 according to the invention generally has a configuration such as the one described above; however, it is naturally possible to change or omit parts of the configuration within a range not departing from the gist of the invention.

Figure 19:
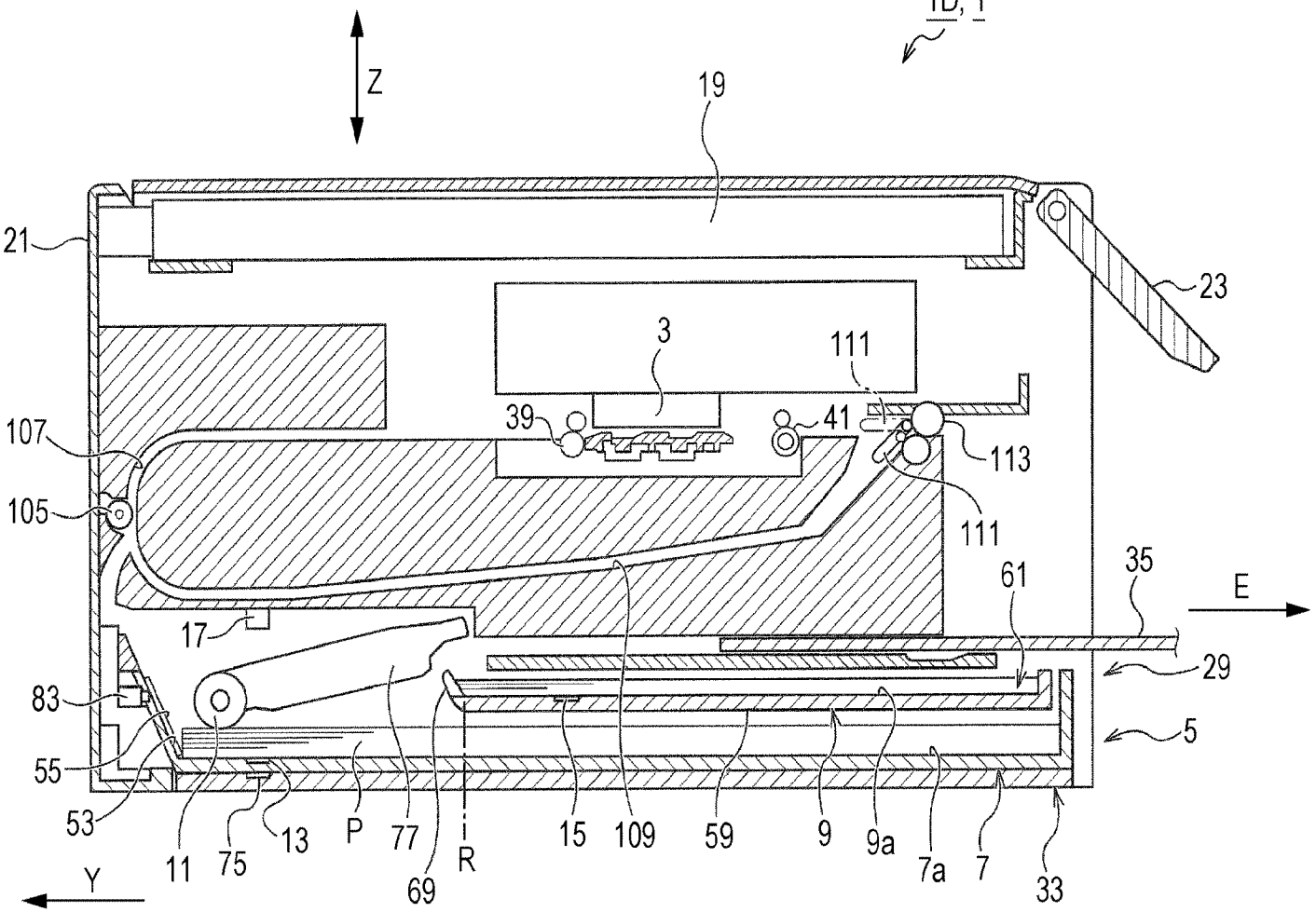
FIG. 19 is a side cross-sectional diagram illustrating a recording apparatus according to another embodiment of the invention when feeding a recording medium from a first tray.

For example, as in a recording apparatus 1D illustrated in FIG. 19, when the paper P, the obverse surface of which is subjected to recording, is caused to reach an inverted path 107 in which a feed roller 105 is disposed, it is also possible to adopt a configuration in which the paper P passes through a return path 109 which is separate from the ordinary path through which the paper P passes when executing the recording.

In this embodiment, a pivoting flap 111 and an induction roller 113 are provided at the branch between the ordinary path downstream of the output roller 41 and the return path 109, and switching between the outputting of the paper P to the outside after the print execution and the transporting of the paper P to the return path 109 in order to execute the recording to the reverse surface of the paper P, as appropriate, by switching the angle of the flap 111 and the rotation direction of the induction roller 113.

Note that, the support portion 33 of the present embodiment is formed of a single member. In other words, in the first embodiment, the support portion 33 is configured to be divided into two portions, the front-side tray support portion 71 and the rear-side tray support portion 73, and a portion of the bottom surface of the first tray 7 is exposed; however, in the present embodiment, since the support portion 33 is formed of a single member, the bottom surface of the first tray 7 is not exposed.

While depiction is omitted, instead of the cut-out portions 44 and 64 which are formed in the reception portion 43*b* of the first moveable edge guide 43 and the reception portion 63*b* of the second moveable edge guide 63, it is possible to adopt an aspect in which at least the part of each of the reception portions 43*b* and 63*b* which is irradiated with the detection light is optically transparent.

Incidentally, even when such an aspect is adopted, the detection light which is radiated from the optical sensor 17 reaches the first reflecting portion 13 and the second reflecting portion 15 without being blocked by the reception portions 43*b* and 63*b*, and it becomes possible to detect the presence or absence of the paper P. Note that, it is possible to adopt an aspect in which at least a portion of the reception portions 43*b* and 63*b* is formed of an optically transparent material with excellent optical transparency such as a colorless transparent material as an aspect with optical transparency.

Instead of the cut-out portions 44 and 64 which are formed in the reception portion 43*b* of the first moveable edge guide 43 and the reception portion 63*b* of the second moveable edge guide 63, the first reflecting portion 13 may be disposed in a position between the two first moveable edge guides 43L and 43R of the first tray 7 which does not interfere with the first moveable edge guides 43L and 43R. In other words, the term "a position which does not interfere" means that the first reflecting portion 13 is positioned outside of the moving region of the first moveable edge guides 43L and 43R.

Similarly, the second reflecting portion 15 may also be positioned in a position between the two second moveable edge guides 63L and 63R which does not interfere with the second moveable edge guides 63L and 63R.

Figure 20:
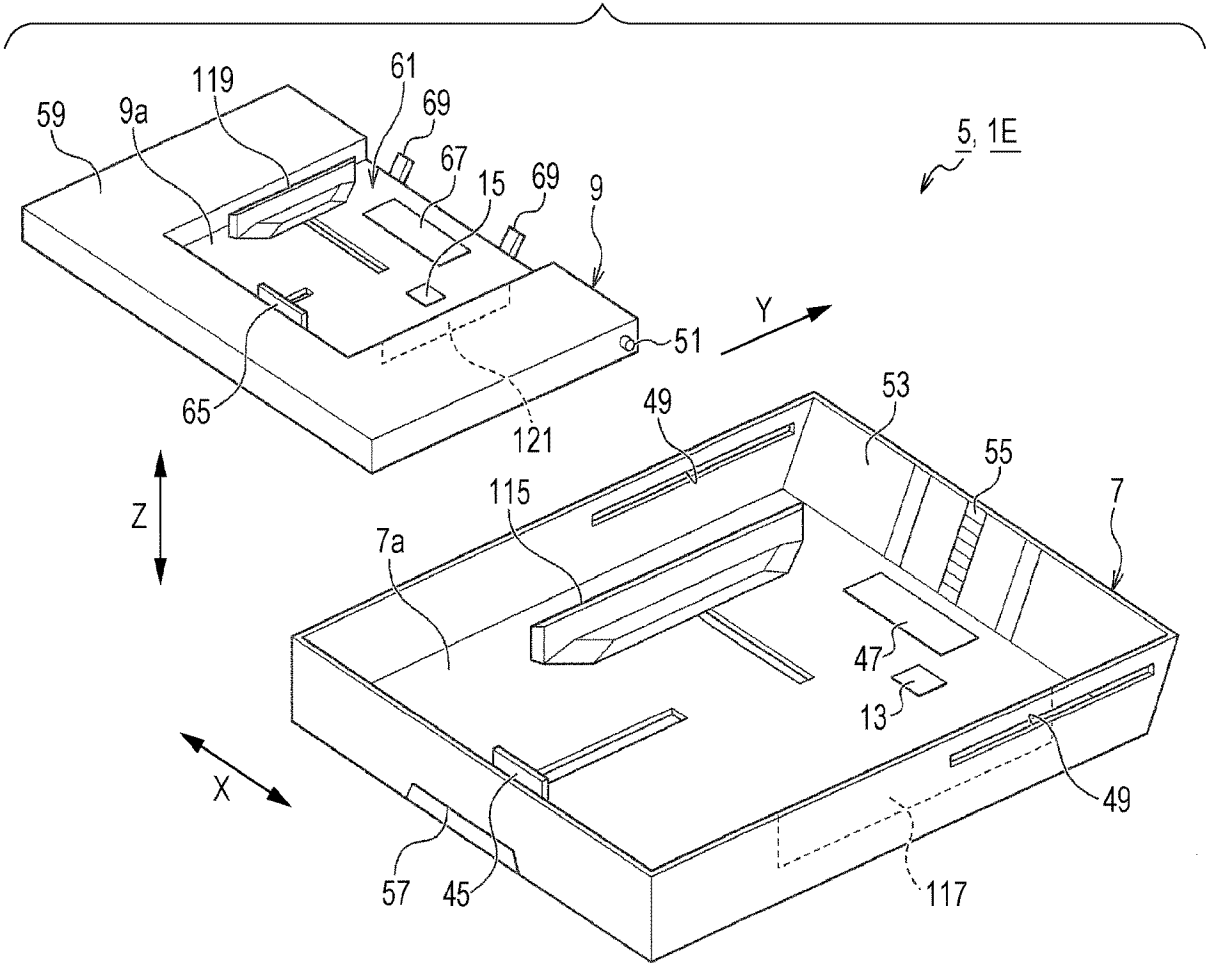
FIG. 20 is a perspective view illustrating a multi-level tray of a recording apparatus according to still another embodiment of the invention in a dismantled state.

An example of the configuration thereof is illustrated in FIG. 20. A recording apparatus 1E is provided with a moveable edge guide 115 and a fixed edge guide 117 on the first tray 7. The moveable edge guide 115 restricts the width of the paper P and is capable of moving in the width direction X, the fixed edge guide 117 is paired with the moveable edge guide 115 and may not move. It is possible to provide the first reflecting portion 13 in a position on the mounting surface 7*a* outside of the movement region of the moveable edge guide 115 close to the fixed edge guide 117.

Similarly, the recording apparatus 1E is provided with a moveable edge guide 119 and a fixed edge guide 121 on the second tray 9. The moveable edge guide 119 restricts the width of the paper P and is capable of moving in the width direction X, the fixed edge guide 121 is paired with the moveable edge guide 119 and may not move. It is possible to provide the second reflecting portion 15 in a position on the mounting surface 9*a* outside of the movement region of the moveable edge guide 119 close to the fixed edge guide 121. The fixed edge guides 117 and 121 are formed of only the restriction portions which are lifted up from the mounting surfaces 7*a* and 9*a* which restrict one end side of the width of the paper P.

Note that, the combination of the moveable edge guide 115 and the fixed edge guide 117 and the combination of the moveable edge guide 119 and the fixed edge guide 121 which are adopted in the embodiment illustrated in FIG. 20 are only applied to one of the first tray 7 or the second tray 9, and for the other tray 9 or 7, it is possible to apply the first and second moveable edge guides 43L, 43R, 63L, and 63R of the configuration described in the first embodiment.

In FIGS. 2, 3, and the like, the optical sensor 17 is depicted in a state of protruding downward from the top plate portion of the bottom region of the recording apparatus main body 21; however, it is preferable to provide the optical sensor 17 in a state of not protruding from the top plate portion. The optical sensor 17 is electrically connected to a circuit such as a central processing unit (CPU) 18 of a main board (not shown) that controls the recording apparatus 1A, including performing the steps illustrated in the flowchart of FIG. 11.

In addition, in the first embodiment described earlier, the distinction of each state is performed by causing the reflectance of the first reflecting portion 13, the second reflecting portion 15, the tray detection reflecting portion 75 (the third reflecting portion), and the paper P to differ; however, since the distances of the reflecting portions 13, 15, 75, and the paper P from the optical sensor 17 are different, even if the reflectance is set the same, the reflected light grows stronger the closer the distance. Therefore, it is also possible to adopt a configuration in which the distinction of each state is performed according to the differences in the strength of the reflected light.

It is possible to omit either one or both of the tray detection reflecting portion 75 and the second tray detection sensor 83 which are adopted in the first embodiment described earlier.

It is also possible to apply the invention to the recording apparatus 1 which is provided with only the first tray 7.

If the recording apparatus is configured to be capable of transacting information with an electronic device such as a portable terminal and to be further capable of operating by the commands from the electronic device, that is, if the recording apparatus is configured to be capable of operating by remote operation (using a communication unit) from a separate place from the place in which the recording apparatus is situated, then, for example, it is possible to perform remote operation such as the switching of the trays and to execute the desired recording in a recording apparatus of a multi-level tray structure.

The operations and effects of each of the aspects of the invention illustrated in the solution described earlier will be described corresponding to the embodiments described above.

According to the first aspect of the invention, since the first reflecting portion 13, which is provided on the mounting surface 7*a* of the first tray 7, and the second reflecting portion 15, which is provided on the mounting surface 9*a* of the second tray 9 and overlaps the first reflecting portion 13 in a direction which orthogonally intersects the mounting surface 9*a* in a state of being positioned in the feeding position F, are provided, it is possible to ascertain whether the recording medium P which is stored in the first tray 7 or the second tray 9 is present or absent from the reflected light of the light which is radiated from the optical sensor 17.

Therefore, when the optical sensor 17 receives the reflected light from the first reflecting portion 13 in a state in which the second tray 9 is in the retraction position R, it becomes possible to determine that the recording medium P is absent from the first tray 7. Meanwhile, since the first reflecting portion 13 is covered by the recording medium P in the state in which the recording medium P is present in the first tray 7, the optical sensor 17 receives the reflected light from the recording medium P, but not from the first reflecting portion 13. Accordingly, it is possible to determine that the recording medium P is present in the first tray 7.

Since a structure is adopted in which the shared feed roller 11 is used to perform the feeding of the recording medium P which is stored in the first tray 7 and the feeding of the recording medium P which is stored in the second tray 9, it is possible to obtain a reduction in the size the number of parts of the apparatus.

In addition, when the second tray 9 moves from the retraction position R to the feeding position F, the first tray 7 assumes a state of being shielded from the light which is radiated from the optical sensor 17 by the second tray 9. In this state, when the optical sensor 17 receives the reflected light from the second reflecting portion 15, it becomes possible to determine that the recording medium P is absent from the second tray 9.

Meanwhile, since the second reflecting portion 15 is covered by the recording medium P in the state in which the recording medium P is present in the second tray 9, the optical sensor 17 receives the reflected light from the recording medium P, but not from the second reflecting portion 15. Accordingly, it is possible to determine that the recording medium P is present in the second tray 9.

In other words, in the recording apparatus 1 which is provided with the multi-level trays 7 and 9 which are capable of feeding the recording medium P using the shared feed roller 11, it is possible to easily perform the determination of whether the recording medium P is present or absent in each of the trays 7 and 9 using the shared optical sensor 17. Therefore, even when the user forgets to set the recording medium P or the like, the fact thereof is detected, and it is possible to preemptively prevent problems in the operation of the recording apparatus which would otherwise occur.

According to the second aspect of the invention, it becomes possible to determine whether the recording medium P is present or absent in two types of the first tray 7, the first tray 7 which is provided with the center-meeting type edge guide which is provided with two moveable edge guides, and the first tray 7 which is provided with a one side base-meeting type edge guide which is provided with only one moveable edge guide.

In other words, since the first reflecting portion 13 is provided in a position outside of the movement region of the edge guide which is capable of moving, it is possible to use the edge guide by moving the edge guide to a position corresponding to the width of the recording medium P which is set in the first tray 7, even if various widths of the recording medium P are set in the first tray 7, and it is possible to easily perform the determination of whether the recording medium P is present or absent in the first tray 7.

According to the third aspect of the invention, it is possible to obtain the same operations and effects as in the second aspect in relation to the recording apparatus 1 which is provided with the first tray 7 in which a pair of edge guides are moveable edge guides which are capable of moving together.

According to the fourth aspect of the invention, it is possible to obtain the same operations and effects as in the first aspect in relation to the recording apparatus 1 which is provided with the first tray 7 in which one edge guide is a moveable edge guide which is capable of moving and the other edge guide is a fixed edge guide which may not be capable of moving. Since the first reflecting portion 13 is provided in a position close to the fixed edge guide 117, it is not necessary to be concerned about the interference of the moveable edge guide, and the installation of the first reflecting portion 13 becomes easy.

According to the fifth aspect of the invention, it becomes possible to determine whether the recording medium P is present or absent in two types of the second tray 9, the second tray 9 which is provided with the center-meeting type edge guide which is provided with two moveable edge guides, and the second tray 9 which is provided with the one-side base meeting type edge guide which is provided with only one moveable edge guide.

In other words, since the second reflecting portion 15 is provided in a position outside of the movement region of the edge guide which is capable of moving, it is possible to use the edge guide by moving the edge guide to a position corresponding to the width of the recording medium P which is set in the second tray 9, even if various widths of the recording medium P are set in the second tray 9 to use the second tray 9, and it is possible to easily perform the determination of whether the recording medium P is present or absent in the second tray 9.

According to the sixth aspect of the invention, it is possible to obtain the same operations and effects as in the fifth aspect in relation to the recording apparatus which is provided with the second tray 9 in which a pair of edge guides are moveable edge guides which are capable of moving together.

According to the seventh aspect of the invention, it is possible to obtain the same operations and effects as in any of the first to fourth aspects in relation to the recording apparatus 1 which is provided with the second tray 9 in which one edge guide is a moveable edge guide which is capable of moving and the other edge guide is a fixed edge guide which may not be capable of moving. Since the second reflecting portion 15 is provided in a position close to the fixed edge guide 121, it is not necessary to be concerned about the interference of the moveable edge guide, and the installation of the second reflecting portion 15 becomes easy.

According to the eighth aspect of the invention, it becomes possible to easily ascertain whether or not the second tray 9 is positioned in the feeding position F using the second tray detection sensor 83. Accordingly, it becomes possible to determine whether to execute the recording on the recording medium P which is stored in the first tray 7 or to execute the recording on the recording medium P which is stored in the second tray 9, and it becomes possible to easily execute the determination of whether the recording medium P is present or absent when executing the recording on the recording medium P which is stored in the second tray 9.

According to the ninth aspect of the invention, since the third reflecting portion 75 which is a region which overlaps the first reflecting portion 13 is provided beneath the first tray 7, it becomes possible to determine whether or not the first tray 7 and the second tray 9 are mounted using the optical sensor 17. Accordingly, it is possible to determine that neither the first tray 7 nor the second tray 9 is positioned in the feeding position F when the optical sensor 17 receives the reflected light from the third reflecting portion 75.

According to the tenth aspect of the invention, since it is possible to install the third reflecting portion 75 using the support portion 33, the installation of the third reflecting portion 75 becomes easy.

According to the eleventh aspect of the invention, since the rigidity of the support portion 33 is improved by providing the protruding portion 79 on a part which corresponds to the third reflecting portion 75 of the support portion 33, the warping of the support portion 33 as time passes is suppressed. By positioning the third reflecting portion 75 on the protruding portion 79 which has improved rigidity, the optical sensor 17 can continually receive the reflected light from the third reflecting portion 75 with good precision.

According to the twelfth aspect of the invention, it is possible to open the first tray 7 by pivoting the second tray 9 in a predetermined direction. In other words, it is possible to greatly expose the first tray 7 from a state in which the first tray 7 is covered by the second tray 9. Accordingly, it becomes easy to set the recording medium P in the first tray 7.

According to the thirteenth aspect of the invention, it is possible to ascertain the presence or absence of the recording medium P which is stored in the first tray 7 from the reflected light which is obtained from the detection light which is radiated from the optical sensor 17 hitting the target object and returning. Accordingly, it is possible to determine that the recording medium P is present in the first tray 7.

The first reflecting portion 13 is provided in a region which is the mounting surface 7*a* of the recording medium P of the first tray 7, is within the width of the first moveable edge guide 43 in the feed direction, and extends in the feed direction from the reception portion 43*b* at a position at which the first moveable edge guide 43 is at the minimum width; thus, it is possible to perform the determination of whether the recording medium P is present or absent in the first tray 7 which is carried out by optical sensing using the moveable region of the first moveable edge guide 43. Accordingly, it is possible to suppress the increase in size of the recording apparatus 1. It is possible to improve the degree of freedom of the disposition at which the first reflecting portion 13 is provided.

According to the fourteenth aspect of the invention, it is possible to ascertain the presence or absence of the recording medium P which is stored in the second tray 9 from the reflected light which is obtained from the detection light hitting the target object and returning, the detection light being radiated from the optical sensor 17. Accordingly, it is possible to determine that the recording medium P is present in the second tray 9.

The second reflecting portion 15 is provided in a region which is the mounting surface 9*a* of the recording medium P of the second tray 9, is within the width of the second moveable edge guide 63 in the feed direction, and extends in the feed direction from the reception portion 63*b* at a position at which the second moveable edge guide 63 is at the minimum width; thus, it is possible to perform the determination of whether the recording medium P is present or absent in the second tray 9 which is carried out by optical sensing using the moveable region of the second moveable edge guide 63. Accordingly, it is possible to suppress the increase in size of the recording apparatus 1. It is possible to improve the degree of freedom of the disposition at which the second reflecting portion 15 is provided.

According to the fifteenth aspect of the invention, since the second reflecting portion 15 is also provided in the second tray 9 of the multi-level trays 7 and 9 in the thirteenth aspect, it is possible to perform the determination of whether the recording medium P is present or absent in the second tray 9 using optical sensing (an optical sensor 17B).

The second reflecting portion 15 is provided in a position which is the mounting surface 9*a* of the recording medium P of the second tray 9 and does not interfere with the second moveable edge guide 63, that is, outside of the moveable region of the second moveable edge guide 63. Accordingly, it is no longer necessary to provide a cut-out portion in the reception portion 63*b* of the second moveable edge guide 63 which is provided in the second tray 9.

According to the sixteenth aspect of the invention, since the first reflecting portion 13 is also provided in the first tray 7 of the multi-level trays 7 and 9 in the fourteenth aspect, it is possible to perform the determination of whether the recording medium P is present or absent in the first tray 7 using optical sensing.

The first reflecting portion 13 is provided in a position which is the mounting surface 7*a* of the recording medium P of the first tray 7 and does not interfere with the first moveable edge guide 43, that is, outside of the moveable region of the first moveable edge guide 43. Accordingly, it is no longer necessary to provide a cut-out portion in the reception portion 43*b* of the first moveable edge guide 43 which is provided in the first tray 7.

This structure is particularly effective when applied to the recording apparatus which is configured such that the width of the recording medium P which is mounted on the second tray 9 is smaller than the width of the recording medium P which is mounted on the first tray 7.

According to the seventeenth aspect of the invention, when the optical sensor 17 receives the reflected light from the first reflecting portion 13 in a state in which the second tray 9 is in the retraction position R, it becomes possible to determine that the recording medium P is absent from the first tray 7. Meanwhile, since the first reflecting portion 13 is covered by the recording medium P in the state in which the recording medium P is present in the first tray 7, the optical sensor 17 receives the reflected light from the recording medium P, but not from the first reflecting portion 13. Accordingly, it is possible to determine that the recording medium P is present in the first tray 7.

When the second tray 9 moves from the retraction position R to the feeding position F in order to perform the feeding using the shared feed roller 11, the first tray 7 assumes a state of being shielded from the optical sensor 17 by the second tray 9. In this state, when the optical sensor 17 receives the reflected light from the second reflecting portion 15, it becomes possible to determine that the recording medium P is absent from the second tray 9. Meanwhile, since the second reflecting portion 15 is covered by the recording medium P in the state in which the recording medium P is present in the second tray 9, the optical sensor 17 receives the reflected light from the recording medium P, but not from the second reflecting portion 15. Accordingly, it is possible to determine that the recording medium P is present in the second tray 9.

In other words, in the recording apparatus 1 which is provided with the multi-level trays 7 and 9 which are capable of feeding the recording medium P using the shared feed roller 11, it is possible to easily perform the determination of whether the recording medium P is present or absent in each of the trays 7 and 9 using the shared optical sensor 17.

The first reflecting portion 13 is provided on the mounting surface 7*a* of the recording medium P of the first tray 7, in the moveable region of the first moveable edge guide 43. The second reflecting portion 15 is provided on the mounting surface 9*a* of the recording medium P of the second tray 9, in the moveable region of the second moveable edge guide 63. Accordingly, it is possible to perform the determination of whether the recording medium P is present or absent in each of the trays 7 and 9 using optical sensing by using the moveable regions of each of the moveable edge guides 43 and 63.

Therefore, it is possible to suppress the increase in size of the recording apparatus 1. It is possible to improve the degree of freedom of the disposition at which the first reflecting portion 13 and the second reflecting portion 15 are provided.

Even when the user forgets to set the recording medium P or the like, the fact thereof is detected, and it is possible to preemptively prevent problems in the operation of the recording apparatus 1 which would otherwise occur.

According to the eighteenth aspect of the invention, the reception portions 43*b* and 63*b* are provided with the cut-out portions 44 and 64, and it is possible to realize a configuration in which a simple structure is adopted and the detection light of the optical sensor 17 is capable of reaching the reflecting portions 13 and 15.

According to the nineteenth aspect of the invention, since the reception portions 43*b* and 63*b* are formed of a material which is capable of transmitting the detection light of the optical sensor 17, and it is possible to realize a configuration in which a simple structure is adopted and the detection light of the optical sensor 17 is capable of reaching the reflecting portions 13 and 15.

According to the twentieth aspect of the invention, it is possible to ascertain the presence or absence of the recording medium P which is stored in the first tray 7 from the reflected light which is obtained from the detection light hitting the target object and returning, the detection light being radiated from the optical sensor 17. Accordingly, it is possible to determine that the recording medium P is present in the first tray 7.

When the optical sensor 17 receives the reflected light from the tray detection reflecting portion 75, it is possible to determine that the first tray 7 is not in a position at which it is possible to execute the recording. In this case, the first tray 7 which can be inserted and removed is either not inserted to the correct position in the recording apparatus 1, or is removed.

Since the user can obtain the information described above, the usability of the recording apparatus 1 is improved.

In other words, it is possible to perform the determination of whether the recording medium P is present or absent in the first tray 7 and the determination of the insertion or removal state of the first tray 7 to the recording apparatus 1 using the shared optical sensor 17.

According to the twenty first aspect of the invention, it is possible to ascertain the presence or absence of the recording medium P which is stored in the second tray 9 from the reflected light which is obtained from the detection light hitting the target object and returning, the detection light being radiated from the optical sensor 17. Accordingly, it is possible to determine that the recording medium P is present in the second tray 9.

When the optical sensor 17 receives the reflected light from the tray detection reflecting portion 75, neither the first tray 7 nor the second tray 9 is present in a position at which the detection light of the optical sensor 17 hits. In this case, the first tray 7 which can be inserted and removed is either not inserted to the correct position in the recording apparatus 1, or is removed. The second tray 9 which can be inserted and removed is either positioned in the retraction position R, not inserted to the correct position in the recording apparatus 1, or is removed.

Since the user can obtain the information described above, the usability of the recording apparatus 1 is improved.

In other words, it is possible to perform the determination of whether the recording medium P is present or absent in the second tray 9 and the determination of the insertion or removal state of the second tray 9 to the recording apparatus 1 using the shared optical sensor 17.

According to the twenty second aspect of the invention, it becomes possible to easily ascertain whether or not the second tray 9 is positioned in the feeding position F using the second tray detection sensor 83. Accordingly, it becomes possible to determine whether to execute the recording on the recording medium P which is stored in the first tray 7 or to execute the recording on the recording medium P which is stored in the second tray 9, and it becomes possible to easily execute the determination of whether the recording medium P is present or absent when executing the recording on the recording medium P which is stored in the second tray 9.

According to the twenty third aspect of the invention, it becomes possible to use the first reflecting portion 13 which is provided on the mounting surface 7*a* of the recording medium P of the first tray 7, and when an optical sensor for the first reflecting portion 13 is used to detect the reflected light from the first reflecting portion 13, it becomes possible to determine that the recording medium P is absent from the first tray 7. Meanwhile, since the first reflecting portion 13 is covered by the recording medium P in the state in which the recording medium P is present in the first tray 7, the optical sensor for the first reflecting portion 13 receives the reflected light from the recording medium P, but not from the first reflecting portion 13. Accordingly, it is possible to determine that the recording medium P is present in the first tray 7.

According to the twenty fourth aspect of the invention, since the first reflecting portion 13 overlaps the second reflecting portion 15 in a direction which orthogonally intersects the mounting surface 9*a* in a state in which the second tray 9 is moved to the feeding position F, when the optical sensor 17 receives the reflected light from the first reflecting portion 13 in a state in which the second tray 9 is in the retraction position R, it is possible to determine that the recording medium P is absent from the first tray 7. Meanwhile, since the first reflecting portion 13 is covered by the recording medium P in the state in which the recording medium P is present in the first tray 7, the optical sensor 17 receives the reflected light from the recording medium P, but not from the first reflecting portion 13. Accordingly, it is possible to determine that the recording medium P is present in the first tray 7.

When the second tray 9 moves from the retraction position R to the feeding position F in order to perform the feeding using the shared feed roller 11, the first tray 7 assumes a state of being shielded from the optical sensor 17 by the second tray 9. In this state, when the optical sensor 17 receives the reflected light from the second reflecting portion 15, it becomes possible to determine that the recording medium P is absent from the second tray 9. Meanwhile, since the second reflecting portion 15 is covered by the recording medium P in the state in which the recording medium P is present in the second tray 9, the optical sensor 17 receives the reflected light from the recording medium P, but not from the second reflecting portion 15. Accordingly, it is possible to determine that the recording medium P is present in the second tray 9.

In other words, in the recording apparatus 1 which is provided with the multi-level trays 7 and 9 which are capable of feeding the recording medium P using the shared feed roller 11, it is possible to easily perform the determination of whether the recording medium P is present or absent in each of the trays 7 and 9 using the shared optical sensor 17.

It is possible to determine that neither the first tray 7 nor the second tray 9 is positioned in the feeding position F when the optical sensor 17 receives the reflected light from the tray detection reflecting portion 75.

In other words, the first tray 7 and the second tray 9 which can be inserted and removed are not inserted to the correct position in the recording apparatus 1 or are removed, and the second tray 9 is positioned in the retraction position R.

Since the user can obtain the information described above, the usability of the recording apparatus 1 is improved.

In other words, it is possible to perform the determination of whether the recording medium P is present or absent in the first tray 7, the determination of whether the recording medium P is present or absent in the second tray 9, and the determination of the insertion or removal state of each of the trays 7 and 9 to the recording apparatus 1 using the shared optical sensor 17.

According to the twenty fifth aspect of the invention, since it is possible to install the tray detection reflecting portion 75 using the support portion 33, the installation of the tray detection reflecting portion 75 becomes easy. Since the support portion 33 is provided with the protruding portion 79 which makes contact with the installation surface 81 on the installation surface 81 side, the rigidity of the support portion 33 is improved by the protruding portion 79, and the warping of the support portion 33 as time passes is suppressed.

According to the twenty sixth aspect of the invention, since the protruding portion 79 is provided on a part which corresponds to the position of the tray detection reflecting portion 75 of the support portion 33, it is possible to continuously receive the reflected light from the tray detection reflecting portion 75 with good precision.

What is claimed is:

1. A recording apparatus comprising:

a recording head which executes recording on a recording medium;

a first tray which stores a recording medium;

a feed roller which is capable of feeding the recording medium in the first tray toward the recording head;

at least one first moveable edge guide which is provided in the first tray, includes a restriction portion which restricts a width of the recording medium and a reception portion which receives a reverse surface of the recording medium, and is capable of moving in a width direction of the recording medium;

a first reflecting portion which is provided such that at least a portion thereof is positioned in a region which is a mounting surface of the recording medium of the first tray, is within a width of a moveable region of the first moveable edge guide in a feed direction, and extends in the feed direction from the reception portion at a position at which the first moveable edge guide is at a minimum width; and an optical sensor which is provided above the mounting surface of the first reflecting portion in a direction which orthogonally intersects the mounting surface, wherein the reception portion of the first moveable edge guide is configured such that detection light of the optical sensor is capable of reaching the first reflecting portion.

2. The recording apparatus according to claim 1, wherein the reception portion is configured to include a cut-out portion such that detection light of the optical sensor is capable of reaching the reflecting portions due to the cut-out portion.

3. The recording apparatus according to claim 1, wherein the reception portion is configured such that at least a part thereof which corresponds to detection light is optically transparent, and the detection light of the optical sensor is capable of reaching the reflecting portions due to the optical transparency.

* * * * *